US005709094A

United States Patent [19]

Ooyabu et al.

[11] Patent Number: 5,709,094

[45] Date of Patent: Jan. 20, 1998

[54] AIR CONDITIONER CONTROL APPARATUS BASED ON COOLANT TYPE DETECTION

[75] Inventors: Yasunori Ooyabu, Kanagawa-ken; Hideaki Motohashi; Megumi Komazaki, both of Shizuoka-ken; Kokichi Furuhama, Tokyo, all of Japan

[73] Assignee: Kabushiki Kaisha Toshiba, Kawasaki, Japan

[21] Appl. No.: 613,886

[22] Filed: Mar. 11, 1996

[30] Foreign Application Priority Data

Mar. 15, 1995 [JP] Japan ..... 7-056246

[51] Int. Cl.[6] ..... F25B 49/00

[52] U.S. Cl. ..... 62/126; 62/225; 62/228.4; 62/502

[58] Field of Search ..... 62/125, 126, 132, 62/228.4, 225, 502

[56] References Cited

U.S. PATENT DOCUMENTS 4,499,739 2/1985 Matsuoka et al. ..... 62/225 X 5,353,604 10/1994 Oguni et al. ..... 62/502 X 5,371,019 12/1994 Manz et al. ..... 62/125 X

*Primary Examiner*—Henry A. Bennett

*Assistant Examiner*—Susanne C. Tinker

*Attorney, Agent, or Firm*—Foley & Lardner

[57] ABSTRACT

An air conditioner control apparatus measures coolant temperatures and pressures at both inlet side and outlet side of a compressor, or detects a electric capacity of the coolant and the like in order to determine the kind of coolant. For example, when a CPU 31 detects that the coolant R22 is used, the apparatus selects a data item of a fluorocarbone-based coolant R22 stored in a data selection means 35 storing pressure-temperature data items, and calculates a super-heated rate or a super-cooled rate according to the ability of a compressor 1 so that the room temperature reaches the predetermined one set by the operator and setting a calculation result. Next, a vapor temperature is calculated by each indoor air conditioner side, and during a cooling operation, electronic expansion valves 9, 11 are controlled so that target super-heated temperature are reached to the temperatures in temperature sensors 17 and 19.

32 Claims, 16 Drawing Sheets

FIG.4A

R22 DATA

| PRESSURE (MPa) | VAPOR TEMPERATURE (℃) |
|---|---|
| 3 | 70.0 |
| 2.9 | 68.3 |
| 2.8 | 66.6 |
| ⋮ | ⋮ |
| 0.1 | -41.1 |

FIG.4B

HFC MIXTURE
COOLANT GAS SIDE DATA

| PRESSURE (MPa) | VAPOR TEMPERATURE (℃) |
|---|---|
| 3 | 68 |
| 2.9 | 66.5 |
| 2.8 | 64.9 |
| ⋮ | ⋮ |
| 0.1 | -37.0 |

FIG.4C

HFC MIXTURE
COOLANT LIQUID SIDE DATA

| PRESSURE (MPa) | VAPOR TEMPERATURE (℃) |
|---|---|
| 3 | 64.1 |
| 2.9 | 62.5 |
| 2.8 | 60.8 |
| ⋮ | ⋮ |
| 0.1 | -44.1 |

FIG.8

| COOLANT | TARGET TEMPERATURE DIFFERENCE BETWEEN FIRST AND SECOND TEMPERATURE SENSORS (deg) |
|---|---|
| R22 | 5 |
| HFC MIXTURE COOLANT OF 3 KINDS OF COOLANTS | 8 |

FIG.9A
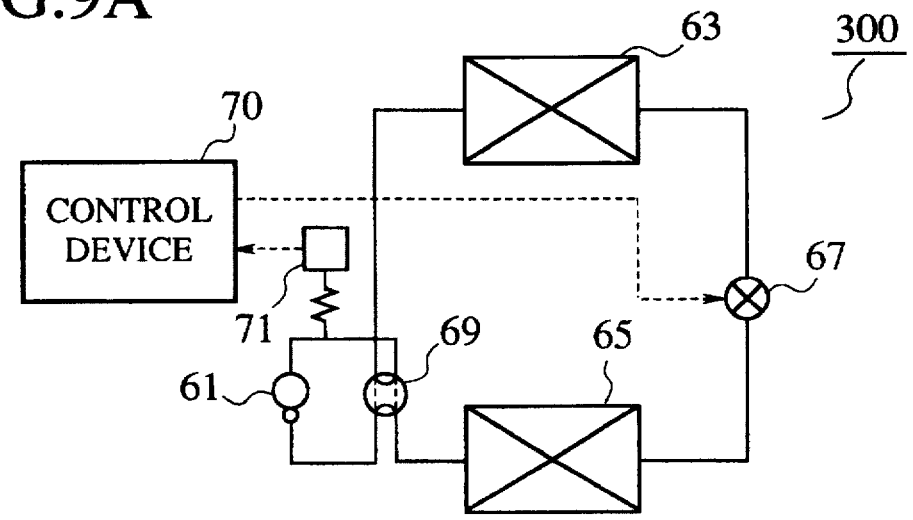
FIG.9B
| COOLANT | VALUES INDICATING ABNORMAL PRESSURE VALUE (MPa) |
|---|---|
| R32 AND R125 OF 1 : 1 WT % | 3.5 |
| R22 | 2.5 |
FIG.9C
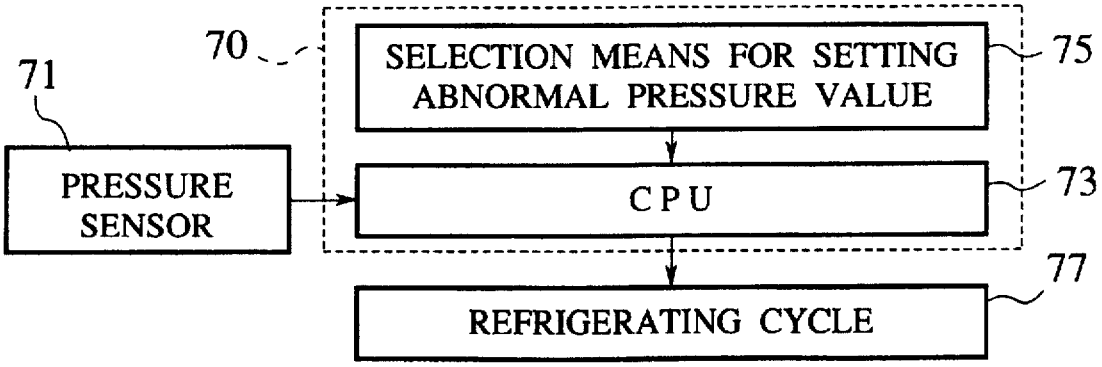

| COOLANT | PROPORTIN CONSTANT K [Hz/Kw] |
|---|---|
| R32 AND R125 OF 1 : 1 WT % | 12 |
| R22 | 20 |

FIG.12

| COOLANT | SLOPE BETWEEN A - B [Kg/Kcal] |
|---|---|
| R22 | 0.068 |
| R32 AND R125 ( 60 WT % AND 40 WT %) | 0.054 |

AIR CONDITIONER CONTROL APPARATUS BASED ON COOLANT TYPE DETECTION

BACKGROUND OF THE INVENTION

1. Field of the Invention

The present invention relates to an air conditioner control apparatus, and more particularly, it relates to an air conditioner control apparatus which is capable of changing control data according to the kind of coolant used for a refrigerating cycle when the coolant is added or replaced and which is capable of operating with a suitable condition.

2. Description of the Prior Art

Recently, it has been determined in the natural environmental protection for Earth (or the natural environment conservation for Earth) that a replacement flon such as HFC (to replace the specified flon CFC and the specified flon HCHC by the replacement flon HFC) not including a chlorine must be used instead of the specified flon CFC and the specified flon HCFC which are used for air conditioners.

Based on the determination described above, at the present time and in a future, when the coolant HCFC used in air conditioners is added or replaced, a replacement flon must be used for the natural environment conservation for Earth. In addition, when air conditioner manufacturers manufacture air conditioners using the replacement flon HFC coolant, it can be easily achieved to satisfy the requirement in the natural environment conservation for Earth described above if parts or components in conventional air conditioners using the specified coolant HCFC are commonly used for new type air conditioners using the replacement flon HFC. In this case, manufacturing costs for air conditioners of the new type can be decreased and reliability of them becomes high.

However, when several kinds of coolants are mixed so that the characteristic of the mixture coolant is approximately equal to that of the HCFC coolant, a temperature gradient characteristic of the mixture coolant becomes different from that of the HCFC coolant. Specifically, when a condense temperature or a vapor temperature of the mixture coolant is different from that of the coolant HCFC, the control of a super-heating rate and the control of super-cooling rate are different from those of the coolant HCFC. For example, there is a problem that a damage to a compressor itself is caused when the compressor sucks a coolant of liquid state which is heated. In addition, in an air conditioner having a plurality of indoor heat exchangers, the heating rate and a super-cooling rate of each indoor heat exchanger is different from each other. In this case, the cooling operation performance or ability of each indoor heat exchanger is also different from each other. As a result, it is difficult to provide a comfortable temperature to users in a room using an indoor heat exchanger having a poor cooling performance.

In addition, because some of coolants of HFC are higher in pressure than coolants of HCFC under a same temperature condition, if a pressure abnormality is caused or happened and detected, it must be stopped to operate the air conditioners. This is a problem.

Furthermore, air conditioners using some of coolants of HFC operating in a same frequency value for a compressor have a very poor cooling performance when comparing them with air compressors using the coolants of HCFC. In those cases, it is difficult to give a comfortable temperature to users or operators using these indoor heat exchangers having a poor cooling performance. This is also a problem.

SUMMARY OF THE INVENTION

Accordingly, the present invention is invented in order to avoid and overcome the problems of the prior art and drawbacks described above.

An object of the present invention is to provide an air conditioner control apparatus which supplies a comfortable cooling circumstance and performance to users by automatically detecting the kind of or the type of coolant and controlling a cooling operation according to the kind of coolant even if a part of the coolant is added or the coolant is replaced with another kind of coolant to be used for the air conditioner.

In order to achieve the object described above, the present invention provides an air conditioner control apparatus as a preferred embodiment, which comprises: control data storing means for storing a plurality of control data items to control a cooling cycle of an air conditioner according to the kind of coolant used in said air conditioner, coolant type detection means for detecting the kind of coolant used in said air conditioner, and data selection means for selecting one of or some of said plurality of control data items according to the kind of coolant detected by said coolant type detection means. Thus, the air conditioner control apparatus of the present invention detects the kind of coolant used in an air conditioner, selects one of or some of the plurality of control data items stored in the control data storing means in order to control the operation of the cooling cycle of the air conditioner, and then controls the cooling cycle so that a room temperature in a room in which the air conditioner is located reaches a specified room temperature smoothly and correctly.

In addition, in order to attain the object described above, the present invention provides an air conditioner control apparatus as another preferred embodiment, which comprises: control program storing means for storing a plurality of programs to control a cooling cycle of an air conditioner according to the kind of coolant used in said air conditioner, coolant type detection means for detecting the kind of coolant used in said air conditioner, and control means for selecting one of or some of said plurality of programs according to the kind of coolant detected by said coolant type detection means and for controlling said cooling cycle of said air conditioner. Thus, the air conditioner control apparatus of the present invention detects the kind of coolant used in an air conditioner, and selects one of or some of the programs stored in the control program storing means according to the detected kind of coolant in order to control the cooling cycle so that a room temperature in a room in which the air conditioner is placed reaches a specified room temperature smoothly and correctly.

Moreover, in the air conditioner control apparatus as another preferred embodiment of the present invention, said coolant type detection means detects said kind of coolant based on a temperature and a pressure of said coolant flowing during said cooling cycle. Thus, the air conditioner control apparatus detects the kind of coolant based on the temperature and the pressure of the coolant during the cooling cycle of the air conditioner when the kind of coolant is detected.

Furthermore, in the air conditioner control apparatus as another preferred embodiment of the present invention, said coolant type detection means detects said kind of coolant based on a temperature and an inlet pressure at an inlet side and a temperature and an outlet pressure at an outlet side of a compressor for compressing said coolant placed in said air conditioner. Thus, the air conditioner control apparatus detects the kind of coolant based on a temperature and an inlet pressure at the inlet side and a temperature and an outlet pressure at the outlet side of the compressor for compressing said coolant when the kind of coolant is detected.

In addition, in the air conditioner control apparatus as another preferred embodiment of the present invention, said coolant type detection means detects said kind of coolant based on an electrostatic capacity of said coolant. Thus, the air conditioner control apparatus detects the kind of coolant based on an electrostatic capacity of the coolant when the kind of coolant is detected.

Moreover, an air conditioner control apparatus as another preferred embodiment of the present invention, in addition to the configuration of the air conditioner control apparatus described above, further comprises one or more floats including a specified kind reference coolant, wherein said coolant type detection means detects a kind of coolant based on a buoyancy of said floats including the reference coolant immersed in said coolant. Thus, the air conditioner control apparatus detects the kind of coolant based on a buoyancy of the floats in which a predetermined kind of coolant is included as a reference coolant. The floats are immersed in the coolant when the kind of coolant is detected.

Furthermore, in the air conditioner control apparatus as another preferred embodiment of the present invention, said coolant type detection means detects said kind of coolant based on an outside temperature of the air conditioner control apparatus and a pressure of said coolant when said air conditioner is stopped. Thus, the air conditioner control apparatus detects the kind of coolant based on an outside temperature of the air conditioner control apparatus and a pressure of said coolant when said air conditioner is stopped.

Moreover, in the air conditioner control apparatus as another preferred embodiment of the present invention, when the kind of coolant detected by said coolant type detection means is unsuitable for an operation of said air conditioner, said air conditioner control apparatus stops an operation of said air conditioner. Thus, the air conditioner control apparatus stops the operation of the air conditioner when the kind of coolant detected by the coolant type detection means is unsuitable for an operation of the air conditioner.

Furthermore, in the air conditioner control apparatus as another preferred embodiment of the present invention, when the kind of coolant detected by said coolant type detection means is unsuitable for an operation of said air conditioner, said air conditioner control apparatus provides information of a detection result to an operator. Thus, the air conditioner control apparatus informs the information regarding to the detection result detected by the coolant type detection means to an operator when the kind of coolant detected by the coolant type detection means is unsuitable for an operation of the air conditioner.

In addition, in the air conditioner control apparatus as another preferred embodiment of the present invention, said control data storing means stores control data items for indicating the most suitable rotating frequency of said compressor to compress said coolant according to said kind of coolant and for indicating a temperature difference between a vapor temperature of said coolant and a temperature of said coolant according to said kind of coolant. Thus, the air conditioner control apparatus uses control data items, as a plurality of control data items in order to control the operation of the air conditioner, indicating a most suitable rotating frequency of the compressor to compress the coolant according to the kind of coolant and control data items indicating a temperature difference between a vapor temperature of the coolant and a temperature of the coolant according to the kind of coolant.

Furthermore, an air conditioner control apparatus as another preferred embodiment of the present invention, comprises: a plurality of indoor air conditioners for exchanging heat between a coolant and air in a room, in which one or more of said plurality of indoor air conditioners is placed, in order to reach a room temperature in said room to a predetermined temperature set by an operator; control data storing means for storing a plurality of control data items in order to control cooling cycles of said plurality of indoor air conditioners according to a kind of coolant used in said plurality of indoor air conditioners; coolant type detection means for detecting the kind of coolant used in said plurality of indoor air conditioners and generating a coolant type data item; control data selection means for selecting one of or some of said plurality of control data items according to the kind of coolant detected by said coolant type detection means; transmission means for transmitting a coolant type data item regarding to said kind of coolant detected by said coolant type detection means to said plurality of indoor air conditioners when said control data items are newly selected according to said coolant type data item indicating said kind of coolant; and receiving means incorporated in each of said plurality of indoor air conditioners for receiving said coolant type data item indicating said kind of coolant transmitted from said transmission means and said control data selection means selects one or more control data items stored in said control data storing means according to said coolant type data item for said plurality of indoor air conditioners. Thus, the air conditioner control apparatus detects the kind of coolant, selects one or more of control data items stored in the control data storing means according to the kind of coolant, and controls the cooling cycle in the indoor air conditioners so that a room temperature can reach a predetermined temperature set by an operator. In this case, when the control data items are newly selected by the control data selection means, a coolant type data item is transmitted to the receiving means incorporated in each of the indoor air conditioners and the control data items are selected based on the received coolant type data item.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 4A through 4C are diagrams showing control data items used for the air conditioner control apparatus 100 of the embodiment 1 as shown in FIG. 1.

FIG. 8 is a diagram showing control data items used for the air conditioner control apparatus 200 of the embodiment 2 as shown in FIG. 5.

FIGS. 9A through 9C are diagrams showing a configuration of an air conditioner control apparatus 300 of the embodiment 3 according to the present invention.

FIG. 12 is a diagram showing control data items used for the air conditioner control apparatus 500 of the embodiment 5 as shown in FIGS. 11A and 11B.

DESCRIPTION OF THE PREFERRED EMBODIMENTS

Hereinafter, preferred embodiments according to the present invention will be explained with reference to the accompanying drawings.

Embodiment 1.

Figure 1:
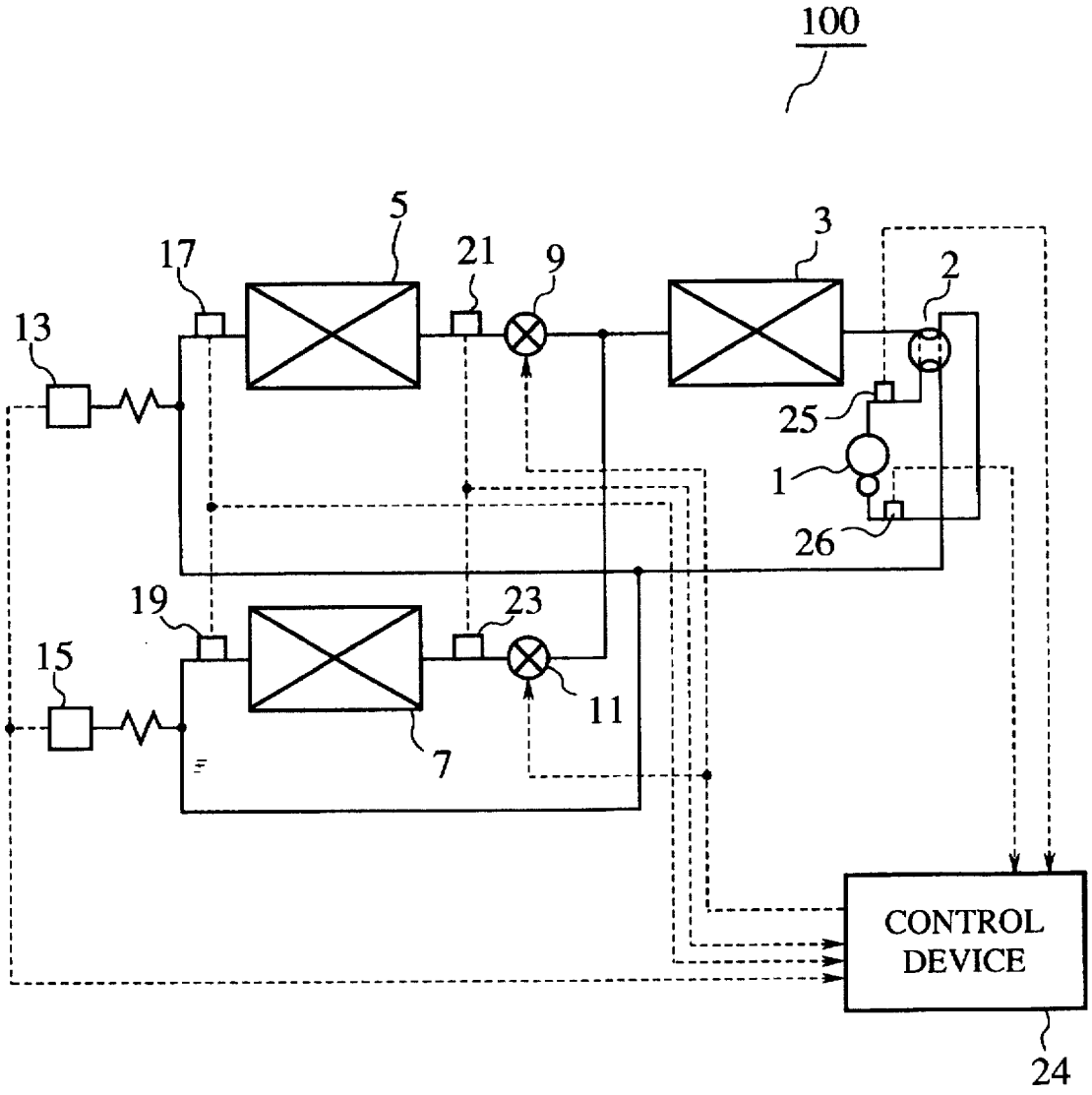
FIG. 1 is a diagram showing a configuration of an air conditioner control apparatus 100 of the embodiment 1 according to the present invention.

FIG. 1 is a diagram showing a configuration of an air conditioner control apparatus 100 of the embodiment 1 according to the present invention. As shown in FIG. 1, a refrigerating cycle configuration of the air conditioner control apparatus 100 comprises a compressor 1 for compressing a coolant gas to a liquid coolant, a four-way valve 2 for switching the direction of a coolant flow, an outdoor heat exchanger 3 located outside of a room for exchanging heat between the coolant and outside air, indoor heat exchangers 5 and 7 for exchanging heat between the coolant and air in rooms in which or in each of which indoor heat exchangers are placed (although FIG. 1 shows the two indoor heat exchangers 5 and 7, the present invention does not limit this configuration, for example, it is acceptable to place more than two indoor heat exchangers in the air conditioner control apparatus), and an electronic expansion valves 9 and 11 for changing the flow rate of the coolant by adjusting opening of the valves 9 and 11.

In addition, as shown in FIG. 1, there are sensors in the air conditioner control apparatus 100 of the embodiment 1, such as temperature sensors 17 and 19 for detecting a vapor temperature of the coolant, temperature sensors 21 and 23 for detecting a temperature of the coolant, pressure sensors 13 and 15 for detecting a pressure of the coolant, and sensors 25 and 26 for detecting temperatures and pressures at both of inlet side and outlet side of the compressor 1. Moreover, as shown in FIG. 1, the air conditioner control apparatus 100 of the embodiment 1 further comprises a control device 24 for receiving the data items regarding the temperatures and pressures of the coolant at both of the inlet side and the outlet side of the compressor 1 transmitted from the sensors 25 and 26, for judging the kind of the coolant and for transmitting a judgement result to the electronic expansion valves 9 and 11.

Figure 2:
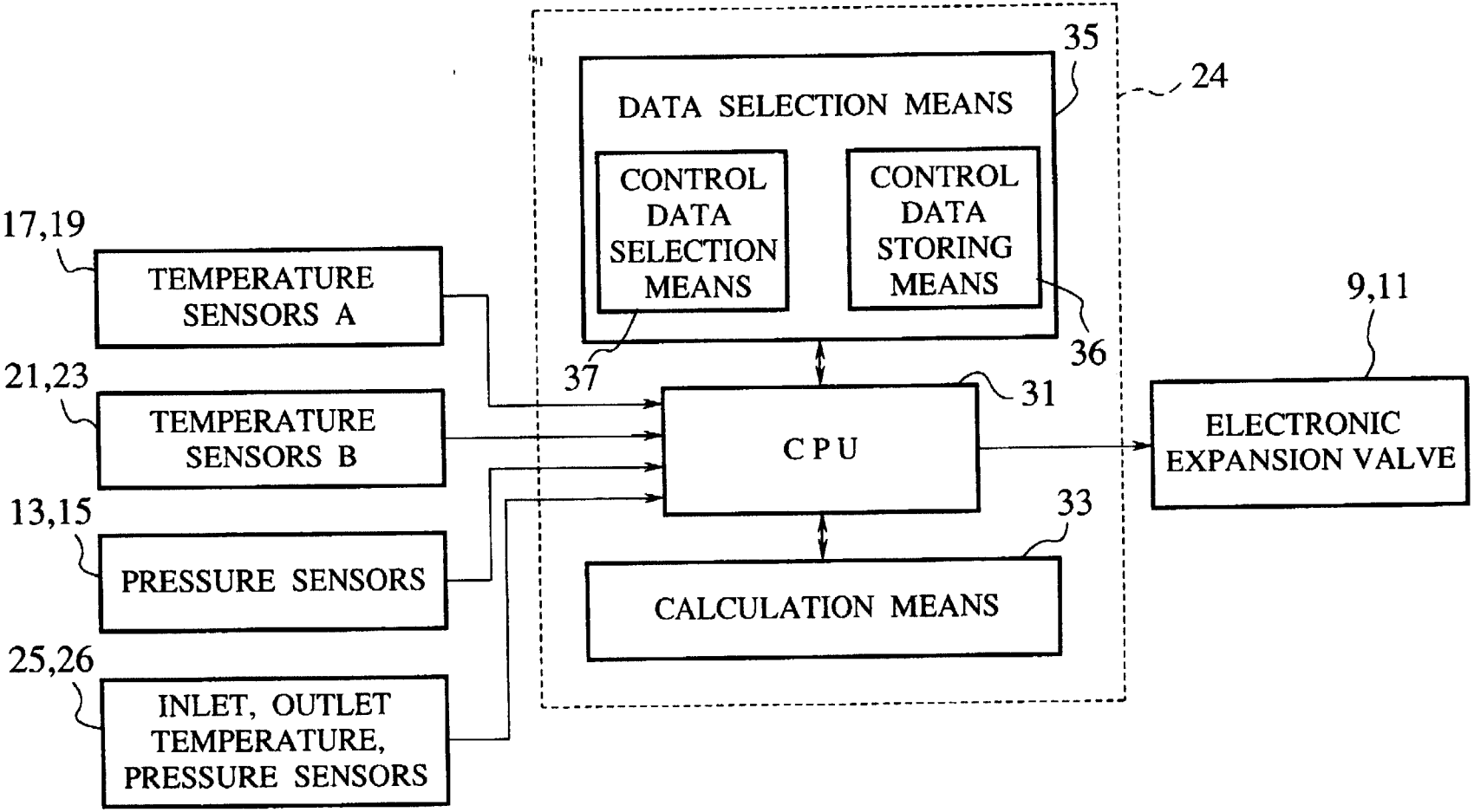
FIG. 2 is a block diagram for explaining the operation of the air conditioner control apparatus 100 of the embodiment 1 as shown in FIG. 1.

FIG. 2 is a block diagram for explaining the operation of the air conditioner control apparatus 100 of the embodiment 1 as shown in FIG. 1. This block diagram shown in FIG. 2 shows the case that the control device 24 controls the performance for each of the indoor heat exchangers 5 and 7.

Figure 3:
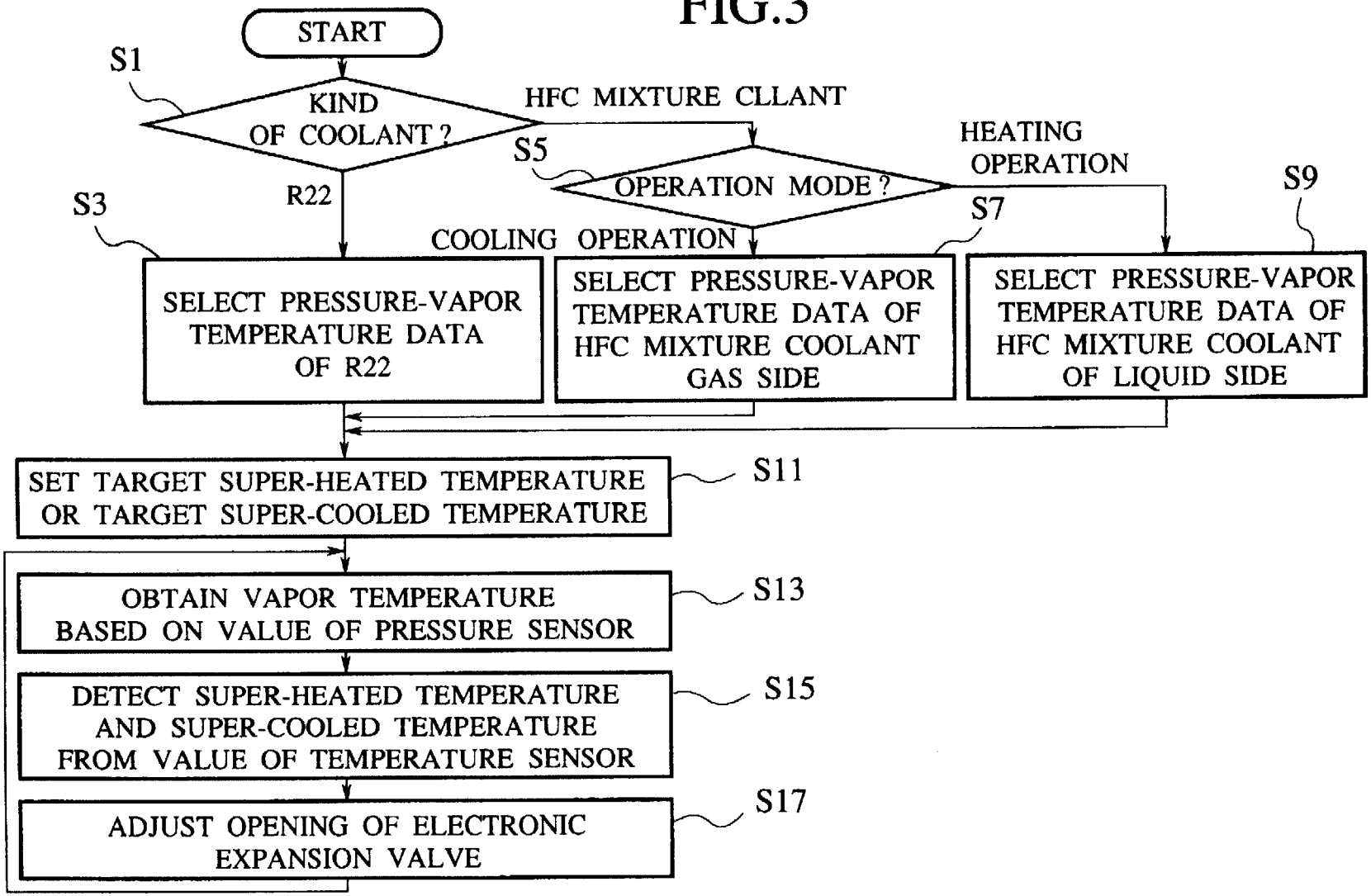
FIG. 3 is a flow chart showing the operation of the air conditioner control apparatus 100 of the embodiment 1 as shown in FIG. 1.

In FIG. 2, the control device 24 in the air conditioner control apparatus 100 has a Central Processing Unit 31 (hereinafter referred to as CPU) for controlling the operation of each indoor heat exchanger according to a control program and control data of the air conditioner control apparatus 100, a calculation means 33 for calculating a superheated temperature value and a super-cooled temperature value according to an operation ability of the compressor 1 to be required for a specified temperature which has been set by an operator so that the room temperature becomes the specified temperature, a data selection means 35 (including a control data storing means 36 and control data selection means 37) of a pressure-temperature for selecting control data corresponding to the kind of the coolant based on the pressure-temperature data tables as shown in FIGS. 4A to 4C. In this case, the CPU 31 corresponds to the coolant type detection means. In addition, pressure-temperature data items of coolants are stored in the control data storing means 36. The control program is written with a series of machine languages so that the air conditioner control apparatus 100 is executed under the flow chart as shown in FIG. 3 by the CPU 31. On the other hand, tables of the control data items are shown in FIGS. 4A to 4C, namely a group of control data for each coolant. Each of these control data items can be read out by the CPU 31.

Next, the operation of an ability control or a performance control to each indoor air conditioner by the air conditioner control apparatus 100 of the embodiment 1 according to the present invention will be explained with reference to FIG. 3, showing a flow chart in accordance with the ability control or the performance control, and FIGS. 4A to 4C, showing correlation data tables of pressure-vapor temperature relationships of coolants.

First, the kind of a coolant flowing and used in the air conditioner control apparatus 100 is detected. For example, the sensors 25 and 26 detect an inlet temperature and an inlet pressure at the inlet side of the compressor 1 and an outlet temperature and an outlet pressure of the compressor 1. The control device 24 then receives these data items. The pressure-enthalpy rate of a coolant during a compression process is based on data items of received inlet temperature and pressure and outlet temperature and pressure. Thereby, the CPU 31 determines the kind of coolant (step S1). In this case, it can be acceptable that the coolant type detection operation is performed by using only inlet and outlet temperatures or only inlet and outlet pressures according to the size of an air conditioner control apparatus. In addition, it can be acceptable to detect the kind of coolant by using electrostatic capacity of the coolant, or a buoyancy of a float immersed in the coolant, or the relationship of a pressure of the coolant and a temperature of the coolant and so on. These methods will be described later in detail.

At step S1, when it is detected that a fluorocarbone-based coolant R22 is used, the pressure-vapor temperature data of the coolant R22 (see FIG. 4A) stored in the data selection means 35 is selected (step S3).

On the other hand, when it is detected that HFC mixture coolant is used, it is checked whether the operation mode set by an operator is the heating operation mode or the cooling operation mode (step S5).

At step S5, it is detected that the cooling operation mode is selected, the pressure-vapor temperature data of HFC mixture coolant in a gas state (see FIG. 4B) stored in the data selection means 35 is selected (step S7).

On the other hand, at step S5, it is detected that the heating operation mode is selected, the pressure-vapor temperature data of the HFC mixture coolant in a liquid state (see FIG. 4C) stored in the data selection means 35 is selected (step S9).

Next, after the steps S3, S7 and S9, the calculation means 33 calculates a target super-heated temperature or a target super-cooled temperature required for an object temperature set by an operator, and the calculation result is set into the CPU 31 (step S11).

Next, the vapor temperature is calculated by using data from the pressure sensors 13 and 15 in each of the indoor heat exchangers (step S13), the openings of the electronic expansion valves 9 and 11 are changed so that the values of the temperature sensors 17 and 19 become the target super-heated temperature when in the cooling operation mode, and so that the values of the temperature sensors 21 and 23 become the target super-cooled temperature when in the heating operation mode (step S15 and S17).

In this case, in general, when the super-heated temperature and the super-cooled temperature are small, the ability to be required for the operation becomes large. On the other hand, when the super-heated temperature and the super-cooled temperature are large, the ability to be required for the operation becomes small.

As shown in FIGS. 4A to 4C, there are data items of fluorocarbone-based coolant R22, HFC mixture coolant data items for gas, and HFC mixture coolant data items for liquid as correlation data items showing a pressure-vapor temperature relationship of each coolant, respectively. These correlation data table are stored in a memory incorporated in the selection means 35 for a pressure-vapor temperature relationship incorporated in the control device 24, as shown in FIG. 2. However, it can be acceptable that these correlation data tables are stored into another unit.

For example the HFC mixture coolant are made up of three coolants such as R32 of 23 wt %, R125 of 25 wt % and R134 of 52 wt %.

The HFC mixture coolant has a temperature gradient of a vapor temperature of each component such as R32, R125 and R134*a*. In addition, the HFC mixture coolant has a different vapor temperature in a liquid state and a gas state of the HFC mixture coolant itself. Therefore, during the cooling operation mode, the vapor temperature is obtained based on the correlation data table of pressure-vapor temperature for gas as shown in FIG. 4B, and during the heating operation mode, the vapor temperature is obtained based on the correlation data table of pressure-vapor temperature for liquid as shown in FIG. 4C. Accordingly, the air conditioner control apparatus 100 can operate a reasonable super-heated control operation or a reasonable super-cooling operation selecting one of the correlation data tables of temperature-pressure relationships for coolants based on the kind of coolant, even if the coolant is added or replaced with another type of coolant. Further, the content of each of the correlation data tables of temperature-pressure relationships can be changed based on the kind of coolant. In this case, the same control operation described above can be performed.

Accordingly, in the air conditioner control apparatus 100 of the embodiment 1, when the coolant used for this air conditioner control apparatus 100 is replaced with another type of coolant, the refrigerating cycle can be smoothly performed by changing control operation, namely contents of correlation data tables. Therefore the present invention can avoid the causing of any damage to the air conditioner control apparatus 100, specifically the compressor 1, when it sucks in the coolant with super-heated temperature. In addition, the air conditioner control apparatus can supply the suitable operation performance to each of the indoor heat exchangers, so that the most suitable environment can be supplied to each of rooms where the indoor heat exchangers are placed.

Embodiment 2.

Next, the air conditioner control apparatus 200 of the embodiment 2 according to the present invention will be explained.

Figure 5:
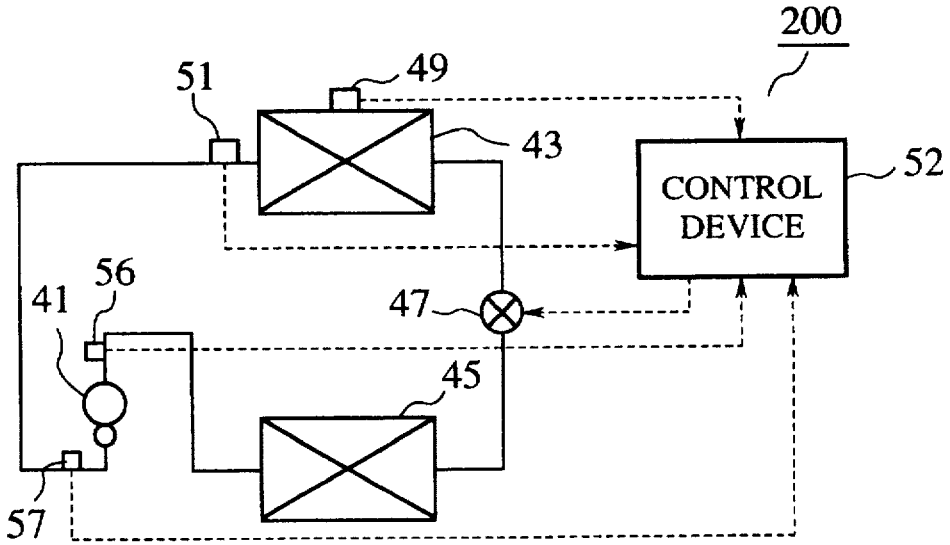
FIG. 5 is a diagram showing a configuration of an air conditioner control apparatus 200 of the embodiment 2 according to the present invention.
Figure 6:
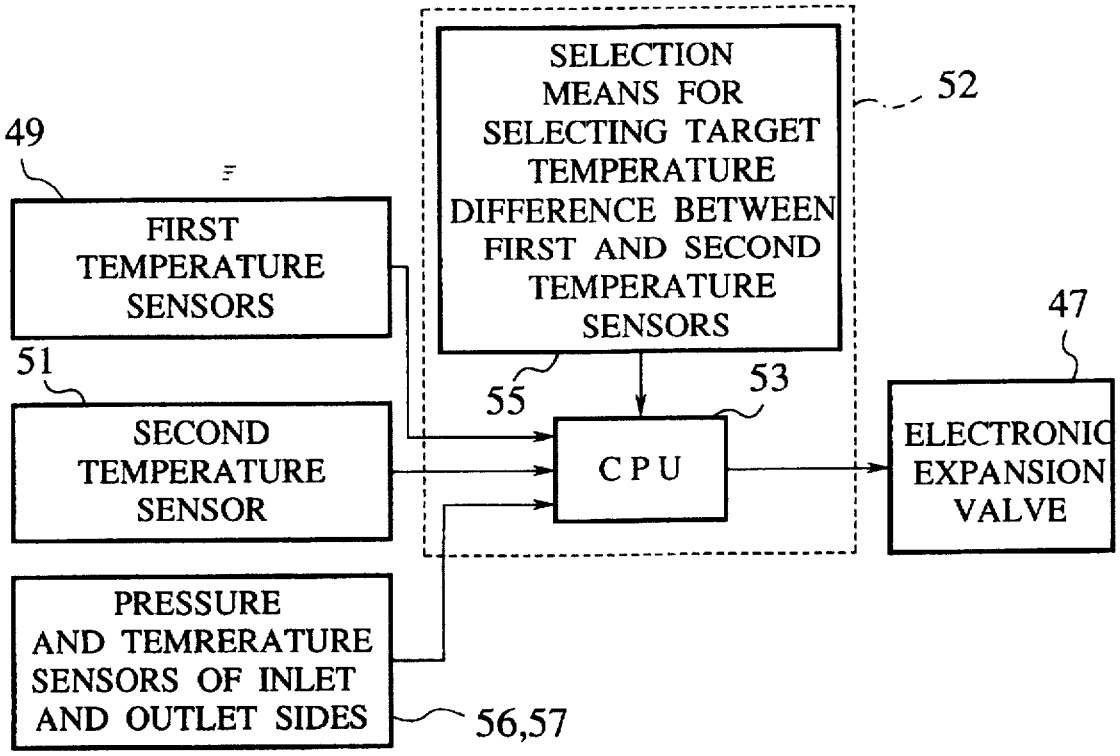
FIG. 6 is a block diagram for explaining the operation of the air conditioner control apparatus 200 of the embodiment 2 as shown in FIG. 5.

FIG. 5 is a diagram showing a configuration of the air conditioner control apparatus 200 of the embodiment 2 according to the present invention. As shown in FIG. 5, the refrigerating cycle configuration of the air conditioner control apparatus 200 comprises: a compressor 41 for compressing a coolant in a gas state to the coolant in a liquid state, an outdoor heat exchanger 45 placed in outside for exchanging heat between outside atmosphere and the coolant, an indoor heat exchanger 49 located in a room for exchanging heat between air in the room and the coolant (although FIG. 5 shows one indoor heat exchanger 49, the present invention does not limit this configuration, for example it is acceptable to place more than one indoor heat exchangers in the air conditioner control apparatus), an electronic expansion valve 47 for changing the amount of the coolant flow by adjusting the opening of the electronic expansion valve 47 itself. In addition, as shown in FIG. 5, sensors incorporated in the air conditioner control apparatus 200 are a first temperature sensor 49 for detecting the vapor temperature of the coolant, a second temperature sensor 51 for detecting the temperature of the coolant, and sensors 56 and 57 for detecting inlet and outlet temperatures at the compressor 41 and inlet and outlet pressures of the compressor. In addition, the air conditioner control apparatus 200 further comprises a control device 52 for determining the kind of coolant and for controlling the operation of the electronic expansion valve 47 based on the detected data items transmitted from the sensors 49, 51, 56 and 57. FIG. 6 is a block diagram for explaining the operation of the air conditioner control apparatus 200 of the embodiment 2 as shown in FIG. 5. In this case, the air conditioner control apparatus 200 controls the operation of each indoor exchanger. Although FIG. 5 and FIG. 6 show the operation of only one indoor heat exchanger 49 for brevity, it can be acceptable to increase the number of indoor heat exchangers in the air conditioner control apparatus, like the air conditioner control apparatus 100 as shown in FIG. 1.

As shown in FIG. 6, the control device 52 comprises a CPU 53 and a selection means 55. Specifically, as shown in FIG. 6, a main section of a control system in the air conditioner control apparatus 200 comprises the CPU 53 for controlling the operation of the indoor heat exchanger 49 based control programs and control data items in the air conditioner control apparatus 200 and the selection means 55 for selecting a temperature difference as a target temperature between the vapor temperature of the coolant detected by the first temperature sensor 49 and the coolant temperature detected by the second temperature sensor 51.

Figure 7:
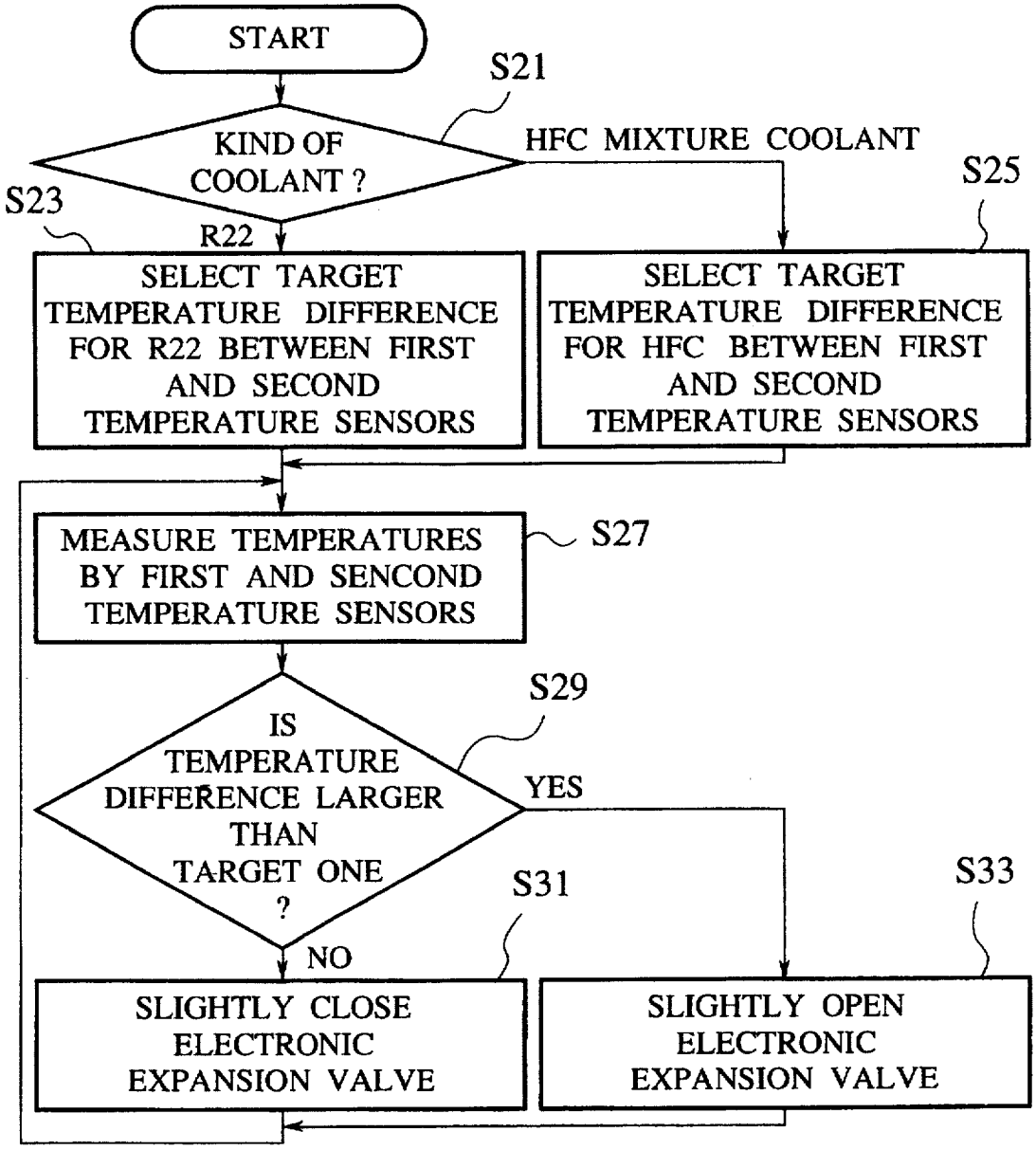
FIG. 7 is a flow chart showing the operation of the air conditioner control apparatus 200 of the embodiment 2 as shown in FIG. 5.

Next, the ability control operation for each indoor heat exchanger of the air conditioner control apparatus 200 of the embodiment will be explained with reference to the flow chart shown in FIG. 7 and FIG. 8. FIG. 8 shows a target temperature difference value. Thus, FIG. 7 is a flow chart showing the operation of the air conditioner control apparatus 200 of the embodiment 2 as shown in FIG. 5. FIG. 8 is a diagram showing control data items used for the air conditioner control apparatus 200 of the embodiment 2 as shown in FIG. 5.

First, the kind of coolant is detected (step S21). This kind of the coolant is detected by using data items transmitted from the sensors 56 and 57 detecting inlet and outlet temperatures of the compressor 41 and inlet and outlet pressures of the compressors 41. This detection operation is same in operation as that in the step S1 of the embodiment 1 as shown in FIG. 1.

Next, at step S21, when it is detected that the kind of coolant is a fluorocarbone-based coolant R22, the data "5 degrees" stored in the selection means 55 for the target temperature value of the temperature difference is selected (step S23).

On the other hand, at step S21, when it is detected that the kind of coolant is a HFC mixture coolant, the data "8 degrees" stored in the selection means 55 for the target temperature value of the temperature difference is selected (step S25).

Next, the first temperature sensor 49 detects the vapor temperature of the coolant, and the second temperature sensor 51 also detects the temperature of the coolant (step S27).

Here, it is detected whether or not the detected vapor temperature of the coolant is greater than that of the target temperature value (step S29).

At step S29, when the temperature difference between the vapor temperature of the coolant and the temperature of the coolant is slightly smaller than the target temperature value, the control device 52 indicates the electronic expansion valve 47 in order to close slightly the opening of the valve 47 itself (step S31).

On the other hand, at step S29, when the temperature difference between the vapor temperature of the coolant and the temperature of the coolant is slightly larger than the target temperature value, the control device 52 indicates the electronic expansion valve 47 in order to open slightly the opening of the valve 47 itself (step S33).

As shown in FIG. 8, target temperature values for the coolant R22 and the HFC mixture coolant of 3 kinds of coolants are stored in a memory (not shown) in the selection means 52 as target temperature differences between the first and second temperatures sensors 49 and 51. This HFC mixture coolant of 3 kinds of coolants is made up of R32 of 23 wt %, R125 of 25 wt %, and R134*a* of 52 wt %.

The HFC mixture coolant has a temperature gradient of a vapor temperature of each component such as R32, R125 and R134*a*. Therefore, as shown in FIG. 8, the target temperature value of the HFC mixture coolant is greater than that of the coolant R22 by 3 degree in order to obtain the same degree of super-heating. Thus, when the target temperature value of the first and second temperature difference is selected according to the kind of the coolant, the super-heating control operation can be executed correctly and suitably even if the coolant is replaced with another type coolant.

It can also be acceptable to change the target temperature values between the first and second temperature sensors 49 and 51 according to the kind of coolant. In this case, the suitable control operation can be performed similarly to the above described case.

Accordingly, the air conditioner control apparatus 200 of the embodiment 2 can operate the suitable control operation in a refrigerating cycle with a correct degree of super-heating by changing a control program even if the coolant is replaced with another type coolant. In addition, the present invention can avoid a damage which would be caused when the compressor 41 sucks in the coolant with super-heated temperature.

Embodiment 3.

Next, the air conditioner control apparatus 300 of the embodiment 3 according to the present invention will be explained.

FIGS. 9A and 9C are diagrams showing a configuration of the air conditioner control apparatus 300 of the embodiment 3 according to the present invention.

As shown in FIG. 9A, the refrigerating cycle configuration of the air conditioner control apparatus 300 of the embodiment 3 comprises a compressor 71 for compressing a coolant gas to a liquid coolant, a four-way valve 69 for switching the direction of a coolant flow, an outdoor heat exchanger 65 placed at outside for exchanging heat between outside air and the coolant, an indoor heat exchanger 63 placed in a room for exchanging heat between air in the room and the coolant (although FIG. 9A shows one indoor heat exchanger 63, the present invention does not limit this configuration, for example it is acceptable to place more than one indoor heat exchangers in the air conditioner control apparatus), and an electronic expansion valve 67 for changing the opening level of it in order to change the flow amount of the coolant.

In addition, as shown in FIG. 9A, the air conditioner control apparatus 300 further comprises a pressure sensor 71 located at a high pressure side of the refrigerating cycle in order to detect a pressure of the coolant.

As shown in FIG. 9C, the control device 70 operates as a control system to control the operation of the air conditioner control apparatus 300, and comprises a CPU 73 for controlling the operation of the indoor heat exchanger 63 according to control programs and control data items for the air conditioner control apparatus, and a set value selection means 75 for selecting a suitable set value from a set value table (see FIG. 9B) in which set values indicating abnormal pressure values according to the kind of coolant. Specifically, the refrigerating cycle configuration has the compressor 61, the four-way value 69, the outdoor heat exchanger 65, the indoor heat exchanger 63, and the electronic expansion valve 67. Further, as shown in FIG. 9B, data of the mixture coolant of R32 (50 wt %) and R125 850 wt %) and of R22 are stored as the abnormal data items in order to detect the occurrence of an abnormal pressure of the coolant.

In the case of the coolant R22, it is well known that the normal pressure value at the high pressure side detected by the pressure sensor 72 is approximately 2 (Mpa). On the other hand, in the mixture coolant of R32 and R125 of 1:1, the normal pressure value at the high pressure side detected by the pressure sensor 72 is approximately 3 (Mpa).

In the air conditioner control apparatus 300 of the embodiment 3 having the configuration described above, in the refrigerating cycle configuration 77 (see FIG. 9C) during a cooling operation, the gas coolant which is compressed by the compressor 71 from the liquid coolant flows into the outdoor heat exchanger 65 through the four-way valve 69. At the outdoor heat exchanger 65, the gas coolant is exchanged to the liquid coolant. Then, this liquid coolant flows to the indoor heat exchanger 63 through the electronic expansion valve 67 whose opening level is adjusted. In the indoor heat exchanger 63, the heat exchanger operation is performed between the liquid coolant and the air in the room. After this, the liquid coolant flows to the pressure sensor 71 through the four-way valve 69. The pressure sensor 71 detects the pressure of the liquid coolant. Then, the liquid coolant is returned to the compressor 61.

On the other hand, the set value selection means 75 selects the set value in the abnormal pressure set value table (as shown in FIG. 9B) according to the kind of the coolant flowing to the refrigerating cycle configuration 77 in the air conditioner control apparatus 300. When the pressure value detected by the pressure sensor 71 is more than the set value in the abnormal pressure set value table shown in FIG. 9B, the control device 70 indicates to stop the operation of the compressor 61.

Accordingly, because the air conditioner control apparatus 300 of the embodiment 3 can select the abnormal pressure set value for detecting the occurrence of an abnormal pressure according to the kind of coolant, the abnormal pressure detection operation can be executed correctly and suitably even if the coolant is replaced with another kind coolant. In addition, the abnormal pressure set values in the table shown in FIG. 9B can be changed. In this case, the abnormal pressure detection operation can be executed similarly to the above described case.

Accordingly, even if the coolant is replaced with another type of coolant, the air conditioner control apparatus 300 of the embodiment 3 can operate the refrigerating cycle operation correctly and suitably by changing the control data items such as the abnormal pressure set values. Therefore the present invention can avoid that the operation of the air conditioner control apparatus 300 is stopped, specifically the compressor 71, caused by misreading a correct pressure value.

Embodiment 4.

Next, the air conditioner control apparatus 400 of the embodiment 4 according to the present invention will be explained.

Figures 10A, 10B:
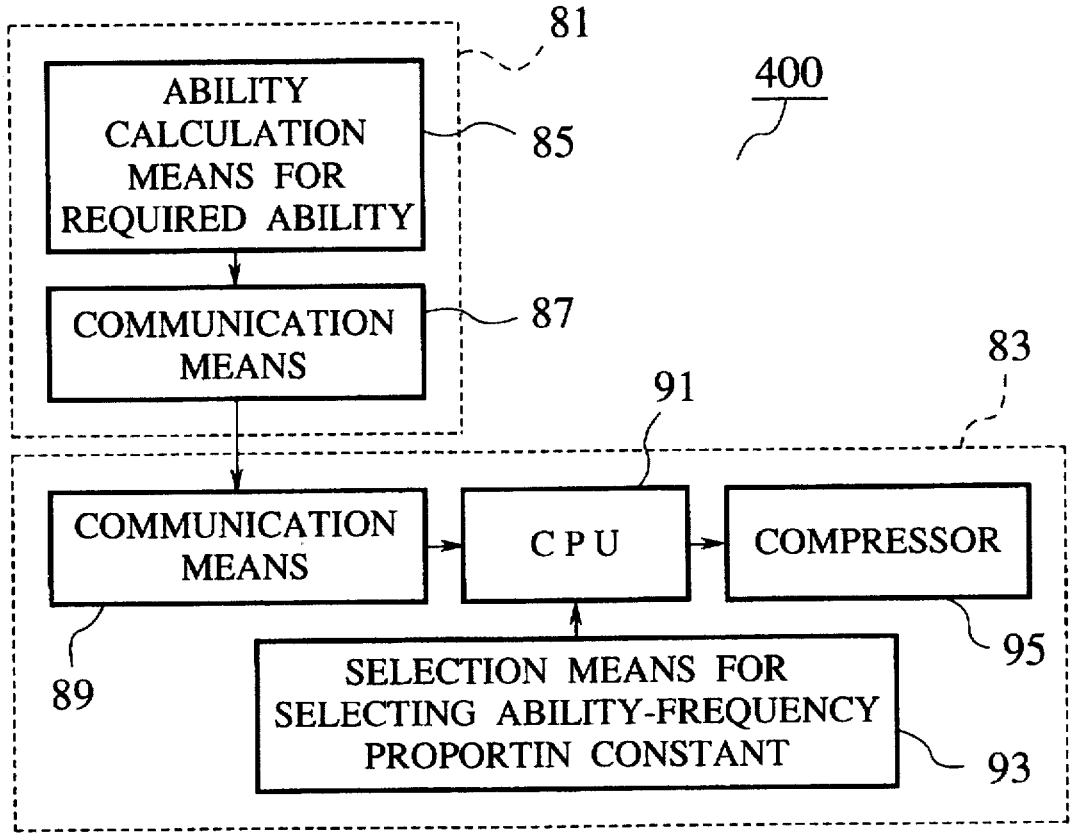
FIGS. 10A and 10B are diagrams showing a configuration of an air conditioner control apparatus 400 of the embodiment 4 according to the present invention.

FIGS. 10A and 10B are diagrams showing a configuration of the air conditioner control apparatus 400 of the embodiment 4 according to the present invention.

As shown in FIG. 10A, the air conditioner control apparatus 400 of the embodiment 4 comprises an indoor heat exchanger 81 having an ability calculation means 85 for calculating a required ability (although FIG. 10A shows one indoor heat exchanger 81, the present invention does not limit this configuration, for example it is acceptable to place more than one indoor heat exchangers in the air conditioner control apparatus) and a communication means 87, and an outdoor heat exchanger 83 including a communication means 89, a control system (including a CPU 91 and selection means 93) for driving the compressor 95 according to an ability indication signal indicating the magnitude of an ability of the compressor 95 to be required transmitted from the indoor heat exchanger 81 to the outdoor heat exchanger 83. Specifically, a control system in the air conditioner control apparatus 300 comprises the ability calculation means 85 for calculating the ability indication signal based on a target temperature set by an operator, the communication means 87 and 89 for transmitting and receiving the ability indication signal between the indoor heat exchanger 81, the CPU 91 for controlling the operation of the compressor 95 according to control programs and control data items, the selection means 93 for selecting a proportion constant "K" in a proportion constant table as shown in FIG. 10B corresponding to the kind of coolant, and the compressor 95 for compressing a coolant gas to a liquid coolant whose operation can be driven by a frequency. An operation frequency "F" of the compressor 95 is defined as follows:

$$F=K\cdot Q.$$

In this embodiment 4, there are the 2 kinds of proportional constant values for two coolants as shown in FIG. 10B, for example. Specifically, the proportional constant table shown in FIG. 10B includes two proportional constant values "K" for a mixture coolant of R32 (50 wt %) and R125 (50 wt %), and a fluorocarbone-based coolant R22. For example, when using the mixture coolant of R32 (50 wt %) and R125 (50 wt %), the ability of the compressor 95 can be provided under the frequency of approximately 30 Hz which is the frequency of about 60% in the case of the fluorocarbone-based coolant R22.

In the air conditioner control apparatus 400 having the configuration described above, the ability indication signal is generated by the ability calculation means 85 so that the room temperature is reached to a predetermined temperature set by an operator, and then the ability indication signal is transmitted to the outdoor heat exchanger 83 through a communication line by the communication means 87.

Next, the communication means 89 receives the ability indication signal form the indoor heat exchanger side 81, the CPU 91 calculates the compressor operation frequency F which is obtained by multiplying the value Q in the received ability indication signal by the proportional constant K selected by the selection means 93. Then, the compressor 95 operates based on the calculated frequency F in order to compress the coolant gas to the liquid coolant, so that the coolant can flow in the most suitable condition.

Thus, the most suitable refrigerating operation can be performed by selecting the proportional constant K according to the kind of coolant by the selection means 93 so that the operation frequency of the compressor 95 becomes the most suitable frequency value, even if the coolant is replaced with another kind coolant. In addition, because the values in the proportional constant table shown in FIG. 10B can be changed according to the kind of coolant, the most suitable operation can be executed.

Accordingly, by using the air conditioner control apparatus 400 of the embodiment 4, when the coolant is replaced, the suitable refrigeration operation can be executed correctly by changing the control data items in the proportion constant table shown in FIG. 10A. Further, the most suitable environment can be supplied to each of rooms where the indoor heat exchangers are placed.

Embodiment 5.

Next, the air conditioner control apparatus 500 of the embodiment 5 according to the present invention will be explained.

Figure 11A:
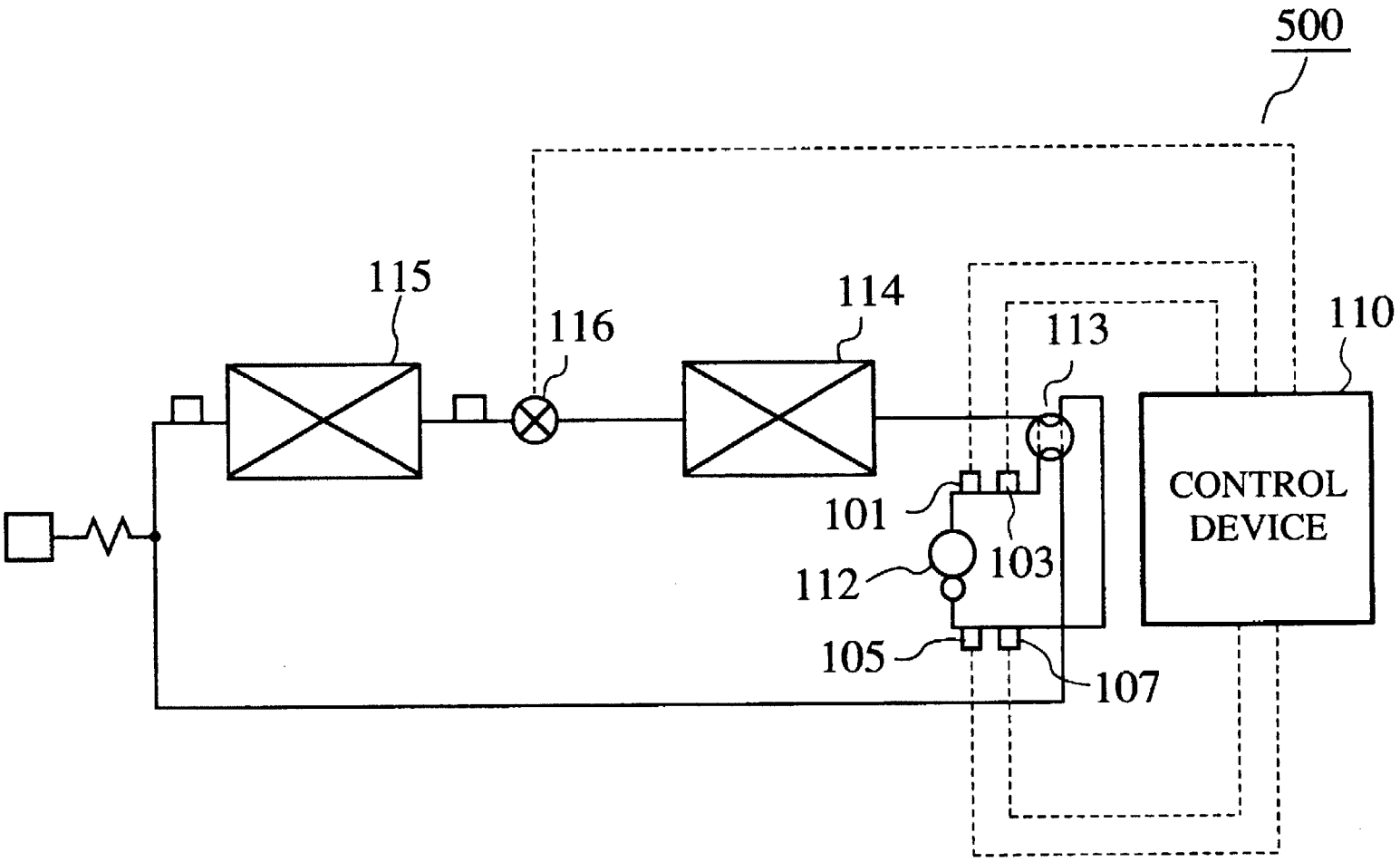
FIGS. 11A and 11B are diagrams showing a configuration of an air conditioner control apparatus 500 of the embodiment 5 according to the present invention.
Figure 11B:
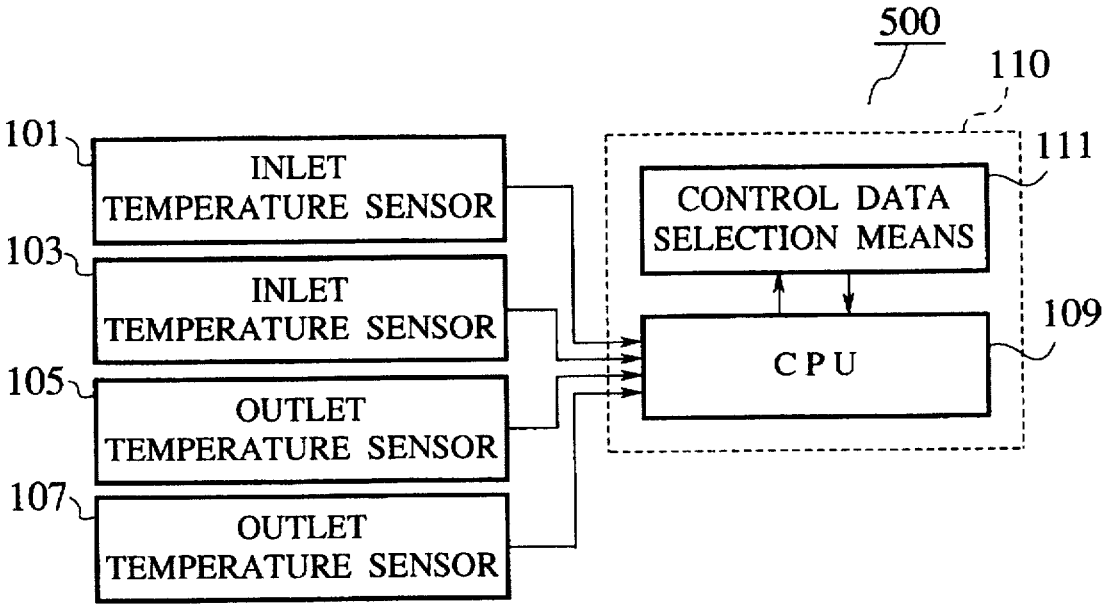

FIGS. 11A and 11B are diagrams showing a configuration of the air conditioner control apparatus 500, mainly showing a control system 110 of the air conditioner control apparatus 500, of the embodiment 5 according to the present invention.

In FIG. 11A, the air conditioner control apparatus 500 comprises a compressor 112 for compressing a coolant gas in a gas state into a liquid coolant in a liquid state, a four-way valve 113 for switching the direction of a coolant flow, an outdoor heat exchanger 114 placed in outside for exchanging heat between outside air and the coolant, an indoor heat exchanger 115 located in a room for exchanging heat between air in the room and the coolant, an electronic expansion valve 116 for changing the amount of the coolant flow by adjusting the opening of the electronic expansion valve 115 itself, sensors 101, 103, 105, 107 for detecting inlet temperature and pressure at the inlet side of the compressor 112 and outlet temperature and pressure at the outlet side of the compressor 112, and control device 110 for receiving detected data items transmitted from the sensors 101, 103, 105 for controlling the operation of the electronic expansion valve 116.

As shown in FIG. 11B, the control device 110 as the control system comprises a CPU 109 for controlling the operation of each indoor heat exchanger 115 (although FIG. 11A shows one indoor heat exchanger 115, the present invention does not limit this configuration, for example it is acceptable to place more than one indoor heat exchangers in the air conditioner control apparatus), a control data selection means 111 for selecting control data according to the kind of coolant, the inlet temperature sensor 101 for detecting an inlet temperature of the compressor 112, the inlet pressure sensor 103 for detecting an inlet pressure of the compressor 112, the outlet temperature sensor 105 for detecting an outlet temperature of the compressor 112, the outlet pressure sensor 107 for detecting an outlet pressure of the compressor 112.

Figure 11C:
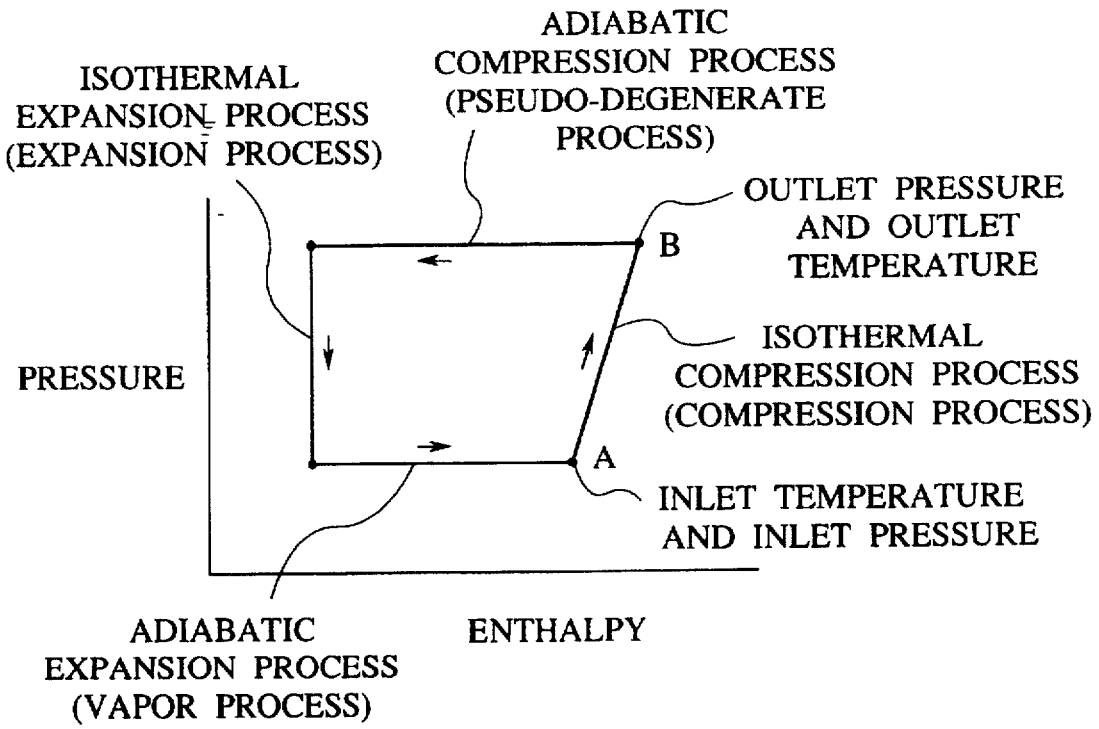
FIG. 11C is a diagram showing a Carnot's cycle of the air conditioner control apparatus 500 of the embodiment 5 as shown in FIG. 11A.

FIG. 11C is a diagram showing a Carnot's cycle showing the relationship between temperature and pressure of the air conditioner control apparatus 500 of the embodiment 5 as shown in FIG. 11A.

As shown in FIG. 11C, the Carnot's cycle consists of the following four steps, which are represented in FIG. 11C, namely a reversible isothermal compression process, a reversible adiabatic compression process, a reversible isothermal expansion process, and a reversible adiabatic expansion process (or a vapor process) starting from the point A. Because the Carnot's cycle of each type of coolants is different to each other, namely each coolant has a intrinsic Carnot's cycle, the kind of coolant can be detected by this feature. Where the slope between the points A and B is defined by using the enthalpies and pressures of the points A and B as follows:

$$\text{Slope of } A\text{–}B = (\log(\text{pressure at } B) - \log(\text{pressure at } A))/((\text{enthalpy at } B) - (\text{enthalpy at } A)).$$

Therefore the CPU 109 can calculate the slope of the points A and B by using the above equation and the detection values detected by the inlet temperature sensor 101, the inlet pressure sensor 103, the outlet temperature sensor 105, and the outlet pressure sensor 107. FIG. 12 is a diagram showing the control data items used for the air conditioner control apparatus 500 of the embodiment 5 as shown in FIGS. 11A and 11B. The calculation results for each of the coolant R22 and the mixture coolant of R31 and R125 are shown in FIG. 12, which are different from each other, for example.

Accordingly, in the air conditioner control apparatus 500 having the configuration described above, the inlet temperature sensor 101, the inlet pressure sensor 103, the outlet temperature sensor 105, and the outlet pressure sensor 107 located at the compressor 112 detect the inlet temperature and pressure, and the outlet temperature and pressure, and then the CPU 109 calculates the value of the slope between the points A and B by using these detected temperature and pressure values. In other words, the CPU 109 can detect the value of the slope A–B which is the intrinsic value of the kind of coolant. Then, the control data selection means 111 selects the control data for each coolant based on the calculation result transmitted from the CPU 109.

Accordingly, in the air conditioner control apparatus 500 of the embodiment 5, when a customer engineer replaces the coolant with another type coolant, the air conditioner control apparatus 500 selects automatically the control is data regarding to the replaced coolant, then operates based on the selected control data. Thereby, it can avoid for a customer engineer to make a mistake to select the control data according to the kind of coolant.

Embodiment 6.

Next, the air conditioner control apparatus 600 of the embodiment 6 according to the present invention will be explained.

Figure 13:
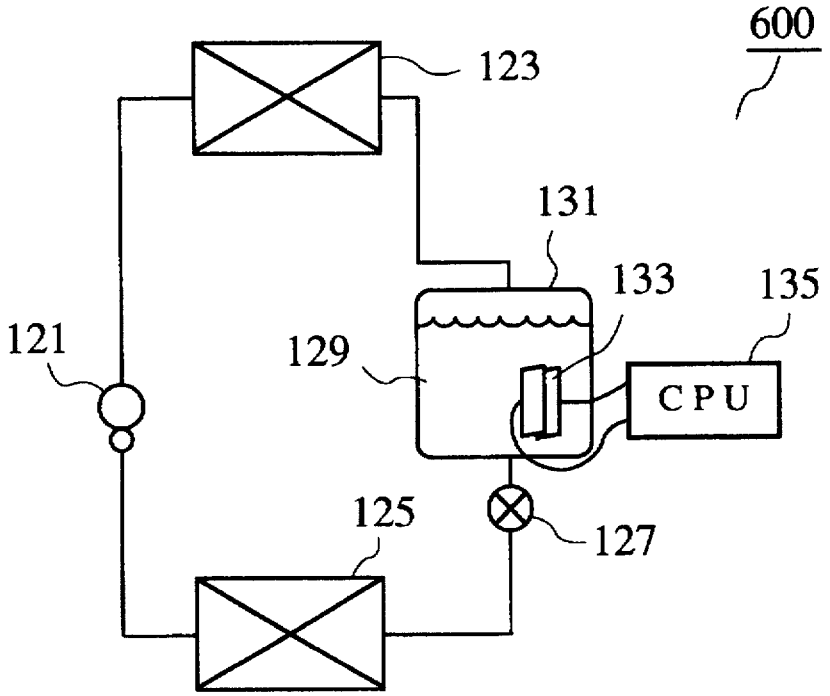
FIG. 13 is a diagram showing a configuration of an air conditioner control apparatus 600 of the embodiment 6 according to the present invention.

FIG. 13 is a diagram showing a configuration of the air conditioner control apparatus 600 of the embodiment 6 according to the present invention.

As shown in FIG. 13, the air conditioner control apparatus 600 comprises a compressor 121 for compressing a coolant gas in a gas state into a liquid coolant in a liquid state, an outdoor heat exchanger 125 placed in outside for exchanging heat between outside air and the coolant, an indoor heat exchanger 123 located in a room for exchanging heat between air in the room and the coolant (although FIG. 13 shows one indoor heat exchanger 123, the present invention does not limit this configuration, for example it is acceptable to place more than one indoor heat exchangers in the air conditioner control apparatus), an electronic expansion valve 127 for changing the amount of the coolant flow by adjusting the opening of the electronic expansion valve 115 itself, and a coolant vessel 131 for storing a coolant 129 of a liquid state.

The main feature part in the air conditioner control device 600 as shown in FIG. 13 further comprises a sensor 133 for detecting an electrical capacity of the coolant 129 and a CPU 135 for controlling the operation of the indoor heat exchanger 123 according to programs and control data items.

In the air conditioner control apparatus 600 of the embodiment 6, the sensor 133 detects the electric capacity of the coolant of a liquid state in the coolant vessel then the CPU 135 detects the kind of the coolant 129 based on the characteristic of the coolant such as the electrical capacity. Then, the CPU 135 selects one of the control data items according to the detection result of the electrical capacity of the coolant and controls the operation of the indoor heat exchanger 128. The following control operation after this is equal to that of the air conditioner control apparatus 500 of the embodiment 5 as shown in FIG. 11A. Therefore, the explanation is omitted here for brevity.

Accordingly, in the air conditioner control apparatus 600 of the embodiment 6, when a customer engineer replaces the coolant with another type coolant, the air conditioner control apparatus 600 selects automatically the control data regarding to the replaced coolant, then operates based on the selected control data. Thereby, it can avoid for a customer engineer to make a mistake to select the control data according to the kind of coolant.

Embodiment 7.

Next, the air conditioner control apparatus 700 of the embodiment 7 according to the present invention will be explained.

Figure 14:
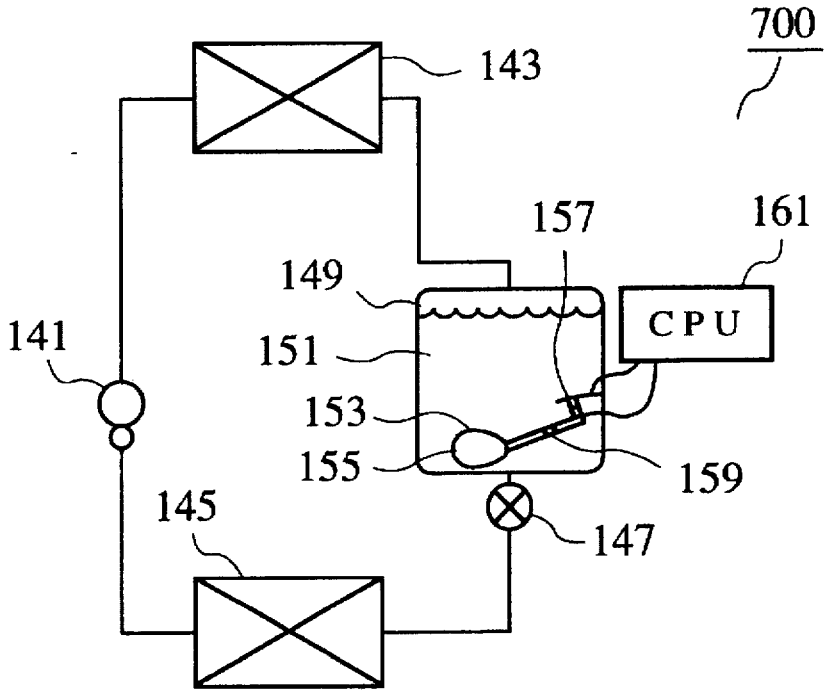
FIG. 14 is a diagram showing a configuration of an air conditioner control apparatus 700 of the embodiment 7 according to the present invention.

FIG. 14 is a diagram showing a configuration of the air conditioner control apparatus 700 of the embodiment 7 according to the present invention.

As shown in FIG. 14, the air conditioner control apparatus 700 comprises a compressor 141 for compressing a coolant gas in a gas state into a liquid coolant in a liquid state, an outdoor heat exchanger 145 placed in outside for exchanging heat between outside air and the coolant, an indoor heat exchanger 143 located in a room for exchanging heat between air in the room and the coolant (although FIG. 14 shows one indoor heat exchanger 148, the present invention does not limit this configuration, for example it is acceptable to place more than one indoor heat exchangers in the air conditioner control apparatus), an electronic expansion valve 147 for changing the amount of the coolant flow by adjusting the opening of the electronic expansion valve 147 itself, and a coolant vessel 149 for storing a coolant 151 of a liquid state.

The main part of the air conditioner control apparatus 700 of the embodiment 7 further comprises a plurality of floats, each of which includes a reference coolant 155, a supporting shaft 159, a switch for detecting the position of the floats in the liquid coolant 151, and a CPU 161 for controlling the operation of the indoor heat exchanger 143 according to control programs and control data items.

In the air conditioner control apparatus 700 of the embodiment 7 having the above configuration, the switch 157 detects that whether or not the position or positions of the floats is or are higher than a predetermined position. Each of these floats includes the reference coolant in it. The density of the reference coolant is different from that of the coolant 151. In other words, the densities of coolants are different to each other, in general. By using this characteristic of each of the coolants, the kind of coolant can be detected. The control operation after this detection operation based on the density of the coolant is basically same as that of the air conditioner control apparatus 500 of embodiment 5, therefore the explanation of the control operation is omitted here for concise expression.

Accordingly, in the air conditioner control apparatus 700 of the embodiment 7, when a customer engineer replaces the coolant with another type coolant, the air conditioner control apparatus 700 selects automatically the control data regarding to the replaced coolant, then operates based on the selected control data. Thereby, it can avoid for a customer engineer to make a mistake to select the control data according to the kind of coolant.

Embodiment 8.

Next, the air conditioner control apparatus 800 of the embodiment 8 according to the present invention will be explained.

Figure 15A:
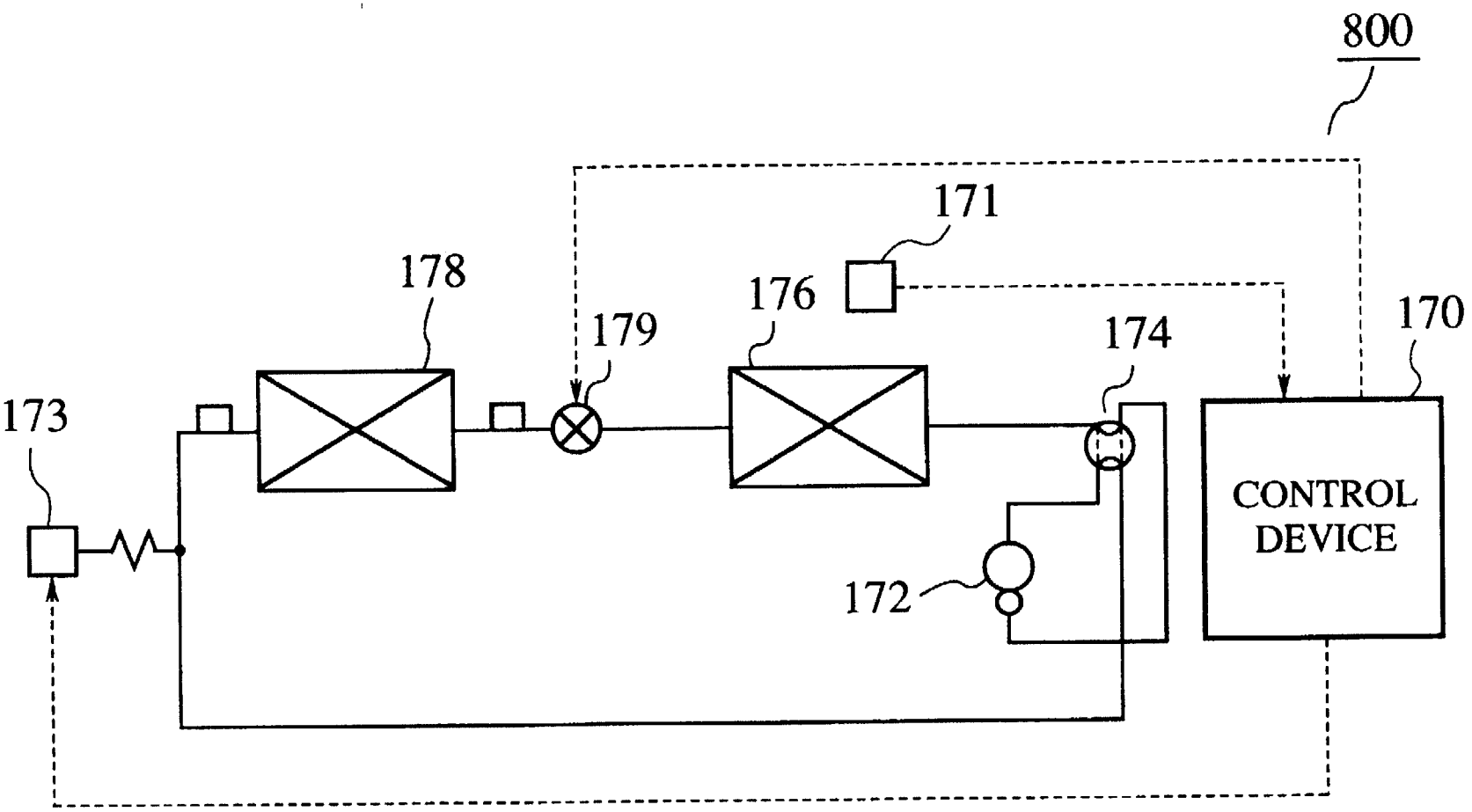
FIGS. 15A and 15B are diagrams showing a configuration of an air conditioner control apparatus 800 of the embodiment 8 according to the present invention.
Figure 15B:
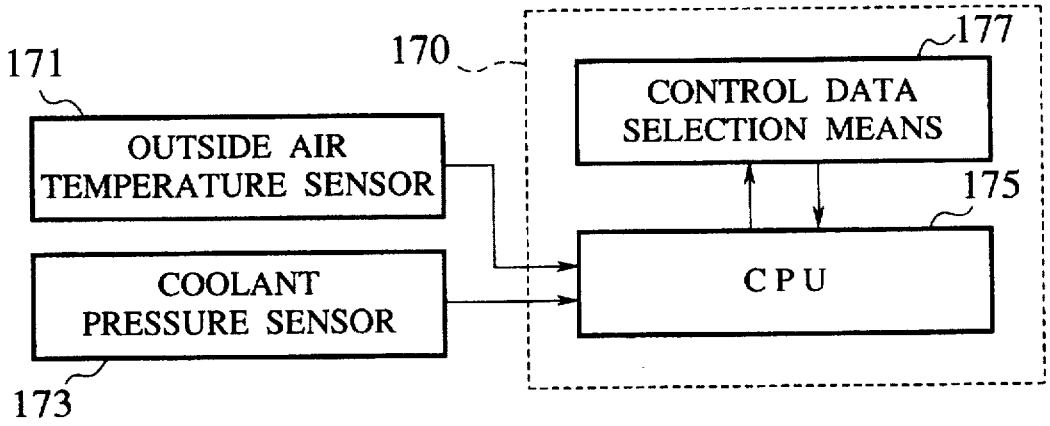

FIGS. 15A and 15B are diagrams showing a configuration of the air conditioner control apparatus 800 of the embodiment 8 according to the present invention.

The air conditioner control apparatus 800 of the embodiment 8 comprises a compressor 172 for compressing a coolant gas in a gas state into a liquid coolant in a liquid state, a four-way valve 174 for switching the direction of the coolant flow, an outdoor heat exchanger 176 placed in outside for exchanging heat between outside air and the coolant, an indoor heat exchanger 178 located in a room for exchanging heat between air in the room and the coolant (although FIG. 15A shows one indoor heat exchanger 178, the present invention does not limit this configuration, for example, it is acceptable to place more than one indoor heat exchangers in the air conditioner control apparatus), an electronic expansion valve 179 for changing the amount of the coolant flow by adjusting the opening level of the electronic expansion valve 179 itself, an outside air temperature sensor 171 for detecting a temperature of outside where the outdoor heat exchanger 176 is placed, for example, a coolant pressure sensor 173, and a control device 170 for receiving the detected data items transmitted from the above sensors 171 and 173 and for determining the kind of coolant and for controlling the operation of the electronic expansion valve 179 based on the detected data items above. In addition, as shown in FIG. 15B, the main control section 170 of the air conditioner control apparatus 800 of the embodiment 8 comprises the outside air temperature sensor 171, the coolant pressure sensor 173, a CPU 175 for controlling the operation of the indoor heat exchanger 178 according to programs and control data items, and a control data selection means 177 for selecting the control data items based on the kind of coolant.

In the air conditioner control apparatus 800 of the embodiment 8 having the configuration described above, while the air conditioner control apparatus 800 stops in operation, the outside air temperature 171 detects the outside air temperature, the coolant pressure sensor 173 detects the coolant pressure during a refrigerating cycle. Specifically, there is an intrinsic relationship between an outside air temperature and a pressure of a coolant when the air conditioner control apparatus 800 stops in operation. By using this feature of a coolant, the kind of the coolant can be detected by the CPU 175. After this determination operation, the control data selection means 177 can select the control data according to the kind of a coolant.

The control operation after this detection operation is basically same as that of the air conditioner control apparatus 500 of embodiment 5, therefore the explanation of the control operation is omitted here for concise expression.

Accordingly, in the air conditioner control apparatus 800 of the embodiment 8, when a customer engineer replaces the coolant with another type coolant, the air conditioner control apparatus 800 selects automatically the control data regarding to the replaced coolant, then operates based on the selected control data. Thereby, it can avoid for a customer engineer to make a mistake to select the control data according to the kind of coolant.

Embodiment 9.

Next, the air conditioner control apparatus 900 of the embodiment 9 according to the present invention will be explained.

Figure 16:
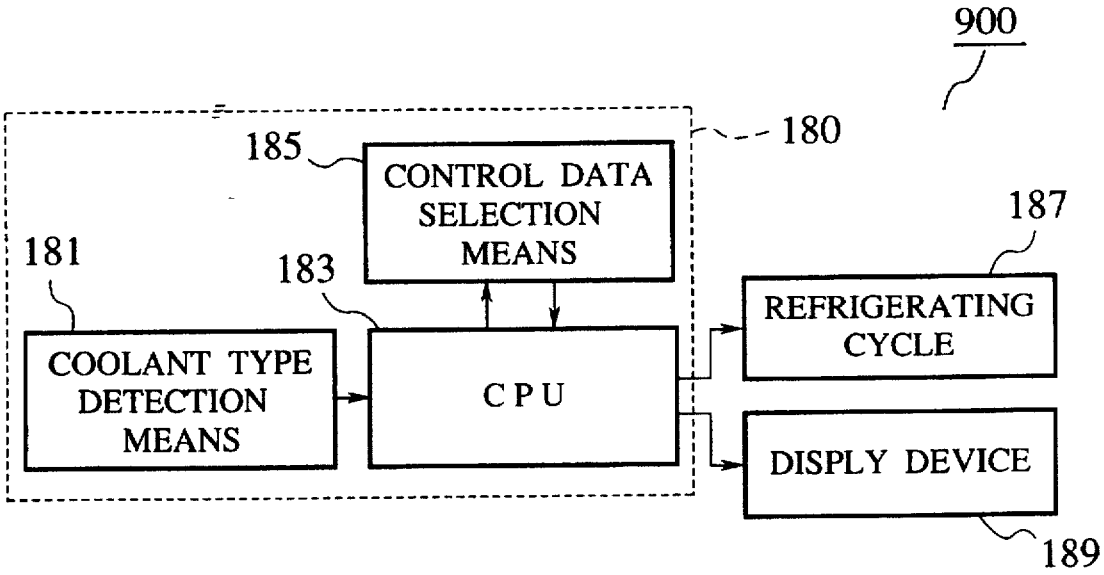
FIG. 16 is a diagram showing a configuration of an air conditioner control apparatus 900 of the embodiment 9 according to the present invention.

FIG. 16 is a diagram showing a configuration of the air conditioner control apparatus 900 of the embodiment 9 according to the present invention.

In FIG. 16, the main control system section in the air conditioner control apparatus 900 of the embodiment 9 comprises various kinds of sensors which have already explained in the air conditioner control apparatus 500 to 800 of the embodiments 5 to 8, a coolant type detection means 181, a CPU for controlling the operation of an indoor heat exchanger based on programs and control data items (not shown, although the embodiment 9 describes one indoor heat exchanger 178 in the air conditioner control apparatus 900, the present invention does not limit this configuration, for example, it is acceptable to place more than one indoor heat exchangers in the air conditioner control apparatus), a control data selection means for selecting the control data according to the kind of coolant, a refrigerating cycle system 187 having a compressor, a four-way valve, an outdoor heat exchanger, and one or more indoor heat exchangers, and a display device 189 for displaying the condition and the state of the air conditioner control apparatus 900. In other words, the control device as the control system mainly comprises the coolant type selection means 181 for determining the kind of coolant, the CPU 183 for controlling the operation of each of the indoor heat exchangers based on the programs and the control data items, and the control data selection means 185 for selecting the control data according to the kind of the coolant detected by the coolant type detection means 181.

Although it is not clearly shown in FIG. 16, the refrigerating cycle configuration comprises the indoor heat exchangers, outdoor heat exchanger, the electronic expansion valve, the pressure sensor, the temperature sensor and a heat exchanger tube through which they are connected to each other and the coolant flows through it. However, because the refrigerating cycle configuration is basically same as that of the air conditioner control apparatus 100 to 800 of the embodiments 1 to 8, the operation of the refrigerating operation is omitted here.

Figure 17:
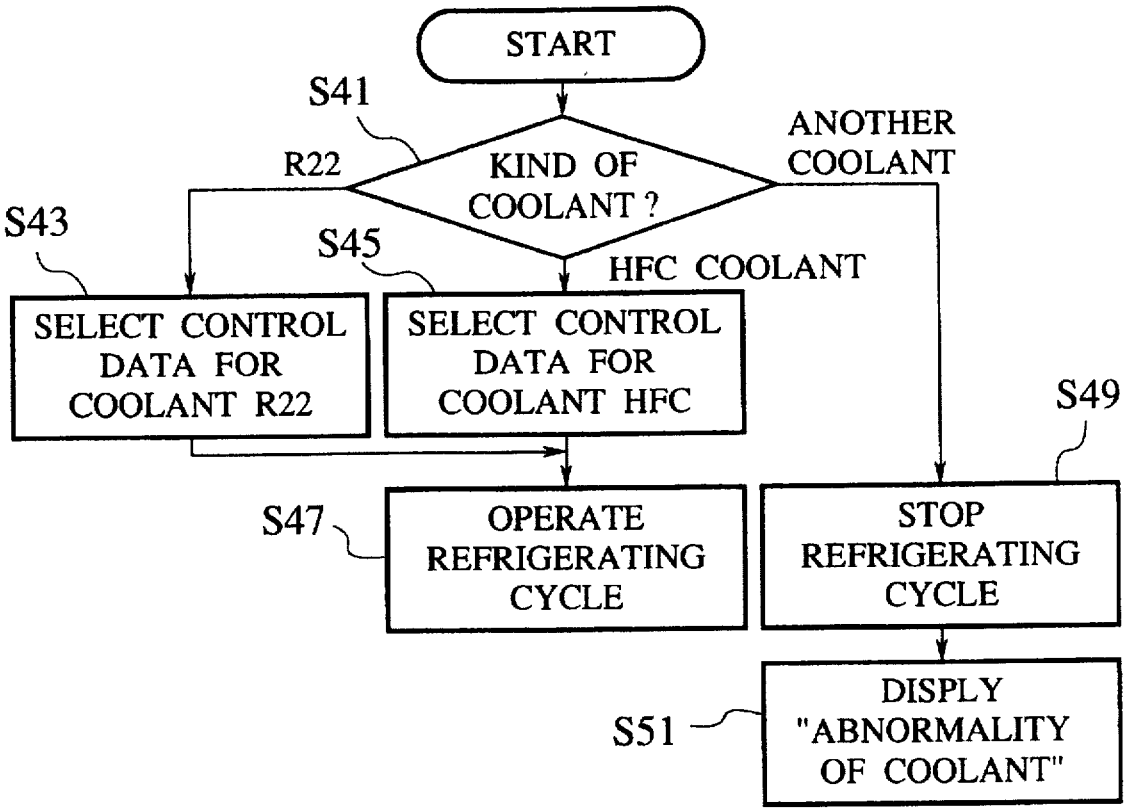
FIG. 17 is a flow chart showing the operation of the air conditioner control apparatus 900 of the embodiment 9 a shown in FIG. 16.

Next, the operation of the air conditioner control apparatus 900 of the embodiment 9 will be explained referring to the flow chart as shown in FIG. 17. FIG. 17 is a flow chart showing the operation of the air conditioner control apparatus 900 of the embodiment 9 as shown in FIG. 16.

First, the coolant type detection means detects the kind of coolant (step S41).

At step S41, when it is detected that the coolant R22 is used, the control data item regarding to the coolant R22 stored in the control data selection means 185 is selected (step S43).

On the other hand, at step S41, when it is detected that the mixture coolant, the HFC mixture coolant is used, the control data relating to the HFC mixture coolant is selected in the control data selection means 185 (step S45).

Next, the refrigerating cycle 187 is driven according to the selected control data selected at the step S43 or S45.

On the other hand, at step S41, when it is detected that other kind of coolant other than the coolant R22 and the HFC mixture coolant is used, the control device indicates to stop the operation of the compressor, because the compressor would be destroyed (step S49).

Next, because other kind of coolant other than the coolant R22 and the HFC mixture coolant is used, the information such as "Coolant Anomaly" or "Abnormality of coolant" is displayed on the display device 189 such as a Cathode Ray Tube (CRT) or a Liquid Crystal Display (LCD) panel by the control device 180 (step S51).

Accordingly, in the air conditioner control apparatus 900 of the embodiment 9, when a customer engineer replaces the coolant with another type coolant, the air conditioner control apparatus 900 selects automatically the control data regarding to the replaced coolant, then the air conditioner control apparatus 900 can operate based on the selected control data. Thereby, it can avoid for a customer engineer to make a mistake to select the control data according to the kind of coolant. Even if the mistake described above happens, the air conditioner control apparatus 900 of the embodiment 9 can stop the operation of itself, specifically it stops the operation of the compressor. Therefore, it can avoid to damage the air conditioner control apparatus.

Embodiment 10.

Next, the air conditioner control apparatus 1000 of the embodiment 10 according to the present invention will be explained.

Figure 18:
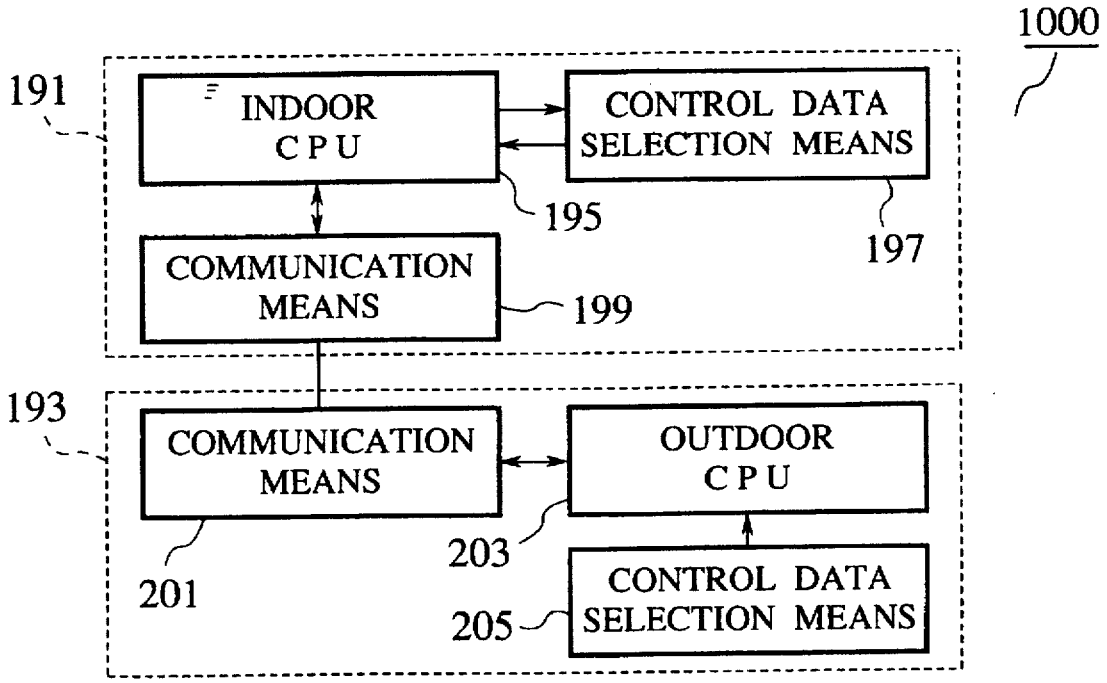
FIG. 18 is a diagram showing a configuration of an air conditioner control apparatus 1000 of the embodiment 10 according to the present invention.

FIG. 18 is a diagram showing a configuration of the air conditioner control apparatus 1000 of the embodiment 10 according to the present invention.

In FIG. 18, the main section of the control system of the air conditioner control apparatus 1000 comprises a control system for transmitting control data items which are rewritten or selected in an indoor heat exchangers 191 to the an outside heat exchanger 193 in order to use same control data in the whole of the indoor heat exchanger and the outdoor heat exchanger (although FIG. 18 shows one indoor heat exchanger 191, the present invention does not limit this configuration, for example, it is acceptable to place more than one indoor heat exchangers in the air conditioner control apparatus). Specifically, the main section of the control system comprises an indoor CPU 195 for controlling the operation of the indoor heat exchanger 191 according to the control data, a control data selection means 197 for selecting the control data according to the kind of coolant, a communication means 199 for transmitting the information relating to the kind of coolant or relating to the control data to the outdoor heat exchanger 193 through a communication line, for example, an outdoor CPU 103 for controlling the operation of the indoor heat exchanger 191 based on programs and control data in the air condition control apparatus 1000, a control data selection means for selecting the control data based on the kind of coolant. The communication means 199 is the transmission means and the communication means 201 forms the receiving means.

In the air conditioner control apparatus 1000 having the configuration described above, when a customer engineer replace the coolant with another type coolant, the control data selection means 197 in the indoor heat exchanger 191 detects the kind of coolant and selects the control data based on the detected kind of coolant. The selected control data or the coolant type information is transmitted to the outdoor heat exchanger 193 through the communication line by using the communication means 199. On the other hand, the communication means 201 in the outdoor heat exchanger 193 receives the control data or the coolant type information transmitted from the indoor heat exchanger 191 through the communication line. The received control data or coolant type information is stored in the control data selection means 205.

After this, the refrigerating cycle in the air conditioner control apparatus 1000 operates based on the control data corresponding to the replaced coolant.

According to the air conditioner control apparatus 1000 of the embodiment 10, when a customer engineer replaces the coolant with another kind coolant, the written or selected control data or coolant type information in the indoor heat exchanger side is transmitted to the outdoor heat exchanger, so that the whole air conditioner control apparatus 1000 performs the refrigerating cycle based on the same control data. In addition, it is not take a lot of time for a customer engineer to operate the outdoor heat exchanger when the coolant is replaced.

In addition, although the whole air conditioner control apparatus 1000 of the embodiment 10 operates based on the same control data by transmitting the control data which is rewritten or changed in the indoor heat exchanger side to the outside heat exchanger, the present invention does not limit this configuration, for example, it is also acceptable that the outdoor heat exchanger which receives the control data from one of indoor heat exchanger transmits the control data to other outdoor heat exchangers. In this case, the number of the outdoor heat exchangers is more than 1 and the number of the outdoor heat exchangers is also more than 1. It is not take a lot of time for a customer engineer to operate the all of outdoor heat exchangers when the coolant is replaced.

Next, the control data selection means 197 in the indoor heat exchanger 191 in the air conditioner control apparatus 1000 of the embodiment 10 will be explained. An example of the control data selection means is an external device. An customer engineer connects this external device to a connecter which is connected electrically to the CPU 195 in the indoor heat exchanger 191. Thereby, control data items relating to a replaced coolant are transmitted to the indoor CPU 195 in the indoor heat exchanger 193 through the connecter when the coolant is replaced.

In addition, as the control data selection means for rewriting the control data relating to a coolant, there is a Read Only Memory (ROM), for example. When a customer engineer replaces the coolant with another type coolant, the ROM in which the control data items relating to the other type coolant have been stored is replaced. This ROM is placed on a IC socket in a CPU board included in the CPU 195 or the CPU 203, for example. Therefore it can be acceptable to use a memory card instead of the ROM described above.

In addition, as the data control selection means for rewriting the control data, there is a photo transistor. In this case, the CPU receives an emitted light from the photo transistor. Thus, when a customer engineer replaces the coolant with another type coolant, the customer engineer operates a remote controller in order to input control data relating to a coolant. The photo transistor emits lights relating to the control data items. The lights are received by a photo transistor in the outdoor heat exchanger side. Then, the received lights relating to the coolant are transmitted to the CPU 203, for example. Thus, the CPU uses the control data regarding to the coolant.

Furthermore, as the data control selection means for rewriting the control data, there is a switch placed in the CPU side. When a customer engineer replaces the coolant with another type coolant, the control data items relating the coolant to be used are selected by electrically switching the switch. In addition, it can be acceptable to use jumper wires instead of the switch.

As described above in detail, the air conditioner control apparatus of the present invention determines the kind of coolant, selects the control data relating to the coolant in a plurality of control data items in order to control the refrigerating cycle, and controls the refrigerating cycle so that the room temperature is reached to a predetermined target temperature. Thereby, the most suitable environment can be supplied to each of rooms where the indoor heat exchangers are placed.

In addition, the air conditioner control apparatus of the present invention determines the kind of coolant, selects one of a plurality of control programs relating to the kind of coolant, and then controls a refrigerating cycle based on the selected program is that a room temperature reaches a predetermined target temperature which is set by an operator. Thereby, the most suitable environment can be supplied to each of rooms where the indoor heat exchangers are placed.

Furthermore, in the air conditioner control apparatus of the present invention, because the kind of coolant is detected based on a temperature of the coolant and a pressure of the coolant during a refrigerating cycle, the kind of coolant can be detected correctly.

Moreover, in the air conditioner control apparatus of the present invention, because the kind of coolant is detected based on inlet temperature and pressure and outlet temperature and pressure of a compressor, the kind of coolant can be detected correctly.

Further, in the air conditioner control apparatus of the present invention, because the kind of coolant is detected based on an electrical capacity of a coolant, the kind of coolant can be detected correctly.

In addition, in the air conditioner control apparatus of the present invention, because the kind of coolant is detected based on a buoyancy of each of floats, each includes a reference coolant, immersed in the coolant, the kind of coolant can be detected correctly.

Furthermore, in the air conditioner control apparatus of the present invention, because the kind of coolant is detected based on an outside air temperature detected during the air conditioner control apparatus stops in operation and a coolant pressure detected while the refrigerating cycle of the air conditioner control apparatus is executed, the kind of coolant can be detected correctly.

Furthermore, in the air conditioner control apparatus of the present invention, when it is determined that the kind of coolant detected is unsuitable for the air conditioner control apparatus, specifically a compressor, the operation of the air conditioner control apparatus is stopped in order to protect the air conditioner control apparatus from damage.

In addition, in the air conditioner control apparatus of the present invention, when it is determined that the kind of coolant detected is unsuitable for the air conditioner control apparatus, specifically a compressor, the information of this fact is informed to an operator through a display, for example, it can be avoided to damage the air conditioner control apparatus.

Furthermore, in the air conditioner control apparatus of the present invention, because control data items indicating a most suitable rotating frequency of a compressor for compressing a coolant according to the kind of coolant and control data items indicating a temperature difference between a vapor temperature and a temperature according to each coolant are used as a plurality of control data items stored for controlling a refrigerating cycle of the air conditioner control apparatus, the most suitable environment can be supplied to each of rooms where the indoor heat exchangers are placed.

Moreover, the air conditioner control apparatus of the present invention selects control data according to the kind of coolant from a plurality of control data items which are stored in order to control a refrigerating cycle, and controls the refrigerating cycle so that a room temperature reaches a predetermined target temperature set by an operator. When the control data is selected, coolant information indicating the kind of coolant is transmitted to other indoor and outdoor heat exchangers. The receiving sides, these indoor and outdoor heat exchanger sides receive the transmitted control data and select control data stored in each heat exchanger side according to the received control data. Therefore the control data can be transmitted to a plurality of heat exchanger sides at one time, each heat exchanger side can operate the refrigerating cycle according to the received control data.

Although the present invention has been described and illustrated in detail, it is clearly understood that the same is by way of illustration and example only and is not to be taken by way of limitation, the spirit and scope of the present invention being limited only by the term of the appended claims.

What is claimed is:

1. An air conditioner control apparatus, comprising:

control data storing means for storing at least two control data items for controlling a cooling cycle of an air conditioner which is driven with one of at least two coolants appropriate for use in said air conditioner;

coolant exchange detection means for detecting replacement of one of said coolants by another of said coolants; and data selection means for selecting one of said control data items corresponding to said another of said coolants for controlling said cooling cycle of said air conditioner.

2. An air conditioner control apparatus as claimed in claim 1, wherein said coolant exchange detection means also detects replacement of said one of said coolants by said another of said coolants which is none of said at least two coolants, and wherein said air conditioner control apparatus further comprises means for stopping an operation of said air conditioner when said one of said coolants is replaced by said another of said coolants which is none of said at least two coolants.

3. An air conditioner control apparatus as claimed in claim 1, wherein said coolant exchange detection means detects replacement of said one of said coolants by said another of said coolants based on a temperature and a pressure of said coolant flowing during said cooling cycle.

4. An air conditioner control apparatus as claimed in claim 1, wherein said coolant exchange detection means detects replacement of said one of said coolants by said another of said coolants based on a temperature and an inlet pressure at an inlet side and a temperature and an outlet pressure at an outlet side of a compressor for compressing said coolant placed in said air conditioner.

5. An air conditioner control apparatus as claimed in claim 1, wherein said coolant exchange detection means detects replacement of said one of said coolants by said another of said coolants based on an electrostatic capacity of said coolant.

6. An air conditioner control apparatus as claimed in claim 1, further comprising one or more floats including a specified kind reference coolant, wherein said coolant exchange detection means detects replacement of said one of said coolants by said another of said coolants based on a buoyancy of said floats including said reference coolant immersed in said coolant.

7. An air conditioner control apparatus as claimed in claim 1, wherein said coolant exchange detection means detects replacement of said one of said coolants by said another of said coolants based on an outside temperature of said air conditioner control apparatus and a pressure of said coolant when said air conditioner is stopped.

8. An air conditioner control apparatus as claimed in claim 1, wherein when replacement of the one of said coolants by said another of said coolants is detected by said coolant exchange detection means, and when said another of said coolants is unsuitable for an operation of said air conditioner, said air conditioner control apparatus stops an operation of said air conditioner.

9. An air conditioner control apparatus as claimed in claim 1, wherein when replacement of the one of said coolants by said another of said coolants is detected by said coolant exchange detection means, and when said another of said coolants is unsuitable for an operation of said air conditioner, said air conditioner control apparatus provide information of a detection result to an operator through an information means.

10. An air conditioner control apparatus as claimed in claim 1, wherein said control data storing means stores control data items for indicating a most suitable rotating frequency of a compressor to compress said coolant according to a kind of coolant and for indicating a temperature difference between a vapor temperature of said coolant and a temperature of said coolant according to said kind of coolant.

11. An air conditioner control apparatus, comprising:

control program storing means for storing at least two programs for controlling a cooling cycle of an air conditioner which is driven with one of at least two coolants appropriate for use in said air conditioner;

coolant exchange detection means for detecting replacement of one of said coolants by another of said coolants; and control means for selecting one of said programs corresponding to said another of said coolants for controlling said cooling cycle of said air conditioner.

12. An air conditioner control apparatus as claimed in claim 11, wherein said coolant exchange detection means also detects replacement of said one of said coolants by said another of said coolants which is none of said at least two coolants, and wherein said air conditioner control apparatus further comprises means for stopping an operation of said air conditioner when said one of said coolants is replaced by said another of said coolants which is none of said at least two coolants.

13. An air conditioner control apparatus as claimed in claim 11, wherein said coolant exchange detection means detects replacement of said one of said coolants by said another of said coolants based on a temperature and a pressure of said coolant flowing during said cooling cycle.

14. An air conditioner control apparatus as claimed in claim 11, wherein said coolant exchange detection means detects replacement of said one of said coolants by said another of said coolants based on a temperature and an inlet pressure at an inlet side and a temperature and an outlet pressure at an outlet side of a compressor for compressing said coolant placed in said air conditioner.

15. An air conditioner control apparatus as claimed in claim 11, wherein said coolant exchange detection means detects replacement of said one of said coolants by said another of said coolants based on an electrostatic capacity of said coolant.

16. An air conditioner control apparatus as claimed in claim 11, further comprising one or more floats including a specified kind reference coolant, wherein said coolant exchange detection means detects replacement of said one of said coolants by said another of said coolants based on a buoyancy of said floats including said reference coolant immersed in said coolant.

17. An air conditioner control apparatus as claimed in claim 11, wherein said coolant exchange detection means detects replacement of said one of said coolants by said another of said coolants based on an outside temperature of said air conditioner control apparatus and a pressure of said coolant when said air conditioner is stopped.

18. An air conditioner control apparatus as claimed in claim 11, wherein when replacement of the one of said coolants by said another of said coolants is detected by said coolant exchange detection means, and when said another of said coolants is unsuitable for an operation of said air conditioner, said air conditioner control apparatus stops an operation of said air conditioner.

19. An air conditioner control apparatus as claimed in claim 11, wherein when replacement of the one of said coolants by said another of said coolants is detected by said coolant exchange detection means, and when said another of said coolants is unsuitable for an operation of said air conditioner, said air conditioner control apparatus provide information of a detection result to an operator through an information means.

20. An air conditioner control apparatus as claimed in claim 11, wherein said control data storing means stores control data items for indicating a most suitable rotating frequency of a compressor to compress said coolant according to a kind of coolant and for indicating a temperature difference between a vapor temperature of said coolant and a temperature of said coolant according to said kind of coolant.

21. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner; and data selection means for selecting at least one of said plurality of control data items according to said kind of coolant detected by said coolant type detection means, wherein said coolant type detection means detects said kind of coolant based on a temperature and a pressure of said coolant flowing during said cooling cycle.

22. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner; and control means for selecting at least one of said plurality of programs according to said kind of coolant detected by said coolant type detection means and for controlling said cooling cycle of said air conditioner, wherein said coolant type detection means detects said kind of coolant based on a temperature and a pressure of said coolant flowing during said cooling cycle.

23. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner; and data selection means for selecting at least one of said plurality of control data items according to said kind of coolant detected by said coolant type detection means, wherein said coolant type detection means detects said kind of coolant based on a temperature and an inlet pressure at an inlet side and a temperature and an outlet pressure at an outlet side of a compressor for compressing said coolant placed in said air conditioner.

24. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner; and control means for selecting at least one of said plurality of programs according to said kind of coolant detected by said coolant type detection means and for controlling said cooling cycle of said air conditioner, wherein said coolant type detection means detects said kind of coolant based on a temperature and an inlet pressure at an inlet side and a temperature and an outlet pressure at an outlet side of a compressor for compressing said coolant placed in said air conditioner.

25. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner;

data selection means for selecting at least one of said plurality of control data items according to said kind of coolant detected by said coolant type detection means; and one or more floats including a specified kind reference coolant, wherein said coolant type detection means detects said kind of coolant based on a buoyancy of said floats including said reference coolant immersed in said coolant.

26. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner;

control means for selecting at least one of said plurality of programs according to said kind of coolant detected by said coolant type detection means and for controlling said cooling cycle of said air conditioner; and one or more floats including a specified kind reference coolant, wherein said coolant type detection means detects said kind of coolant based on a buoyancy of said floats including said reference coolant immersed in said coolant.

27. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner; and data selection means for selecting at least one of said plurality of control data items according to said kind of coolant detected by said coolant type detection means, wherein said coolant type detection means detects said kind of coolant based on an outside temperature of said air conditioner control apparatus and a pressure of said coolant when said air conditioner is stopped.

28. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner; and control means for selecting at least one of said plurality of programs according to said kind of coolant detected by said coolant type detection means and for controlling said cooling cycle of said air conditioner, wherein said coolant type detection means detects said kind of coolant based on an outside temperature of said air conditioner control apparatus and a pressure of said coolant when said air conditioner is stopped.

29. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner; and data selection means for selecting at least one of said plurality of control data items according to said kind of coolant detected by said coolant type detection means, wherein when the kind of coolant detected by said coolant type detection means is unsuitable for an operation of said air conditioner, said air conditioner control apparatus stops an operation of said air conditioner.

30. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner; and control means for selecting at least one of said plurality of programs according to said kind of coolant detected by said coolant type detection means and for controlling said cooling cycle of said air conditioner, wherein when the kind of coolant detected by said coolant type detection means is unsuitable for an operation of said air conditioner, said air conditioner control apparatus stops an operation of said air conditioner.

31. An air conditioner control apparatus, comprising:

control data storing means for storing a plurality of control data items in order to control a cooling cycle of an air conditioner according to a kind of coolant used in said air conditioner;

coolant type detection means for detecting said kind of coolant used in said air conditioner; and data selection means for selecting at least one of said plurality of control data items according to said kind of coolant detected by said coolant type detection means, wherein when the kind of coolant detected by said coolant type detection means is unsuitable for an operation of said air conditioner, said air conditioner control apparatus provides information of a detection result to an operator through an information means.

32. An air conditioner control apparatus, comprising:

control program storing means for storing a plurality of programs in order to control a cooling cycle of an air conditioner according to a kind of coolant used in said air conditioner;

coolant type detection means for detecting said kind of coolant used in said air conditioner; and control means for selecting at least one of said plurality of programs according to said kind of coolant detected by said coolant the detection means and for controlling said cooling cycle of said air conditioner, wherein when the kind of coolant detected by said coolant type detection means is unsuitable for an operation of said air conditioner, said air conditioner control apparatus provides information of a detection result to an operator through an information means.

* * * * *